US005675354A

United States Patent [19]

Katakura et al.

[11] Patent Number: 5,675,354

[45] Date of Patent: Oct. 7, 1997

[54] LIQUID CRYSTAL APPARATUS

[75] Inventors: Kazunori Katakura; Yoshio Hotta, both of Atsugi; Mitsuo Iwayama, Odawara; Tadashi Mihara, Kawasaki, all of Japan

[73] Assignee: Canon Kabushiki Kaisha, Tokyo, Japan

[21] Appl. No.: 344,609

[22] Filed: Nov. 18, 1994

Related U.S. Application Data

[63] Continuation of Ser. No. 816,562, Jan. 3, 1992, abandoned.

[30] Foreign Application Priority Data

Jan. 7, 1991 [JP] Japan ..... 3-010357

[51] Int. Cl.[6] ..... G09G 3/36

[52] U.S. Cl. ..... 345/97; 345/208

[58] Field of Search ..... 395/157, 158; 345/87, 97, 98, 100, 208; 359/55, 56, 84

[56] References Cited

U.S. PATENT DOCUMENTS

| | | | |
|---|---|---|---|
| 4,367,924 | 1/1983 | Clark et al. | 350/334 |
| 4,561,726 | 12/1985 | Goodby et al. | 350/341 |
| 4,569,574 | 2/1986 | Masaki et al. | 350/334 |
| 4,571,565 | 2/1986 | Stein et al. . | |
| 4,589,996 | 5/1986 | Inoue et al. | 252/299.65 |
| 4,592,858 | 6/1986 | Higuchi et al. | 252/299.66 |
| 4,596,667 | 6/1986 | Inukai et al. | 252/299.65 |
| 4,613,209 | 9/1986 | Goodby et al. | 350/350 S |
| 4,614,609 | 9/1986 | Inoue et al. | 252/299.66 |
| 4,622,165 | 11/1986 | Kano et al. | 252/299.65 |
| 4,655,561 | 4/1987 | Kanbe et al. | 350/350 S |
| 4,691,200 | 9/1987 | Stephany | 345/157 X |
| 4,693,563 | 9/1987 | Harada et al. | 340/783 |
| 4,709,995 | 12/1987 | Kuribayashi et al. | 359/56 |
| 4,926,168 | 5/1990 | Yamamoto et al. | 340/784 |
| 5,014,048 | 5/1991 | Knapp | 340/784 |
| 5,041,821 | 8/1991 | Onitsuka et al. | 340/784 |
| 5,058,994 | 10/1991 | Mihara et al. | 359/56 |
| 5,091,723 | 2/1992 | Kanno et al. | 340/784 |
| 5,109,294 | 4/1992 | Hanyu et al. | 359/83 |
| 5,136,282 | 8/1992 | Inaba et al. | 340/811 |
| 5,488,388 | 1/1996 | Taniguchi et al. | 345/208 |

FOREIGN PATENT DOCUMENTS

| | | |
|---|---|---|
| 0091661 | 10/1983 | European Pat. Off. . |
| 0361471 | 4/1990 | European Pat. Off. . |
| 063093 | 3/1988 | Japan . |
| 065494 | 3/1988 | Japan . |

*Primary Examiner*—Richard Hjerpe
*Assistant Examiner*—Amare Mengistu
*Attorney, Agent, or Firm*—Fitzpatrick, Cella, Harper & Scinto

[57] ABSTRACT

A liquid crystal apparatus comprises: matrix electrodes which are formed by a scanning electrode group and an information electrode group which intersect the scanning electrode group so as to face the scanning electrode group; a ferroelectric liquid crystal which is arranged between those electrode groups and is driven by an electric field applied through the electrode groups; a drive circuit having a scanning side drive circuit for sequentially generating scan selection signals to the scanning electrode group and for generating scan non-selection signals to the scanning electrodes whose scan is not selected and an information side drive circuit for generating information signals to the information electrode group synchronously with the scan selection signal in accordance with the input information; and a control circuit for controlling the drive circuit in a manner such that an interval between two scan selection signals which are continuously applied to the same scanning electrode is set to a predetermined period of time smaller than a full screen scanning period.

5 Claims, 26 Drawing Sheets

LIQUID CRYSTAL APPARATUS

This application is a continuation of application Ser. No. 07/816,562 filed Jan. 3, 1992, now abandoned.

BACKGROUND OF THE INVENTION

1. Field of the Invention

The invention relates to a liquid crystal display apparatus using matrix electrodes and, more particularly, to a liquid crystal display apparatus using a ferroelectric liquid crystal.

2. Description of the Related Background Art

Hitherto, a liquid crystal display device in which a liquid crystal compound is filled between a scanning electrode group and a signal electrode group of matrix electrodes to thereby form a number of pixels and image information is displayed is well known. As a method of driving such a liquid crystal display device a partial rewriting scanning method using the memory performance has been proposed in the Official Gazettes of U.S. Pat. No. 4,655,561 and Japanese Patent Application Nos. 61-207326 and 61-212184 and the like. According to the above method, the smoothness of the moving display is held even upon low field frequency scanning.

To display a state in which the cursor moves to the right and left in the horizontal (lateral) direction, only a group of scanning lines of a predetermined number (for instance, 16) in the same area are repetitively partially rewritten and scanned. According to the studies of the inventors of the present invention, it has been found that there is a problem such that when the applying period of a scan selection signal which is applied to the same scanning electrode is short and such a partial rewriting operation is repeated for a short period of time, an orientation state of the ferroelectric liquid crystal in the above area deteriorates, so that a decrease in contrast in such an area or the like as compared with those of the other areas is caused, so that a display quality deteriorates.

SUMMARY OF THE INVENTION

It is an object of the invention to provide a liquid crystal apparatus which can solve the above problems.

Another object of the invention is to provide a liquid crystal apparatus suitable to display the movement of a cursor in the lateral direction.

According to the invention, there is provided a liquid crystal apparatus comprising: matrix electrodes which are formed by a scanning electrode group and an information electrode group which intersect the scanning electrode group so as to face them; a ferroelectric liquid crystal which is arranged between those electrode groups and is driven by an electric field applied through those electrode groups; a drive circuit having a scanning side drive circuit for sequentially generating scan selection signals to the scanning electrode group and for generating scan non-selection signals to the scanning electrodes whose scan is not selected and an information side drive circuit for generating information signals to the information electrode group in accordance with input information synchronously with the scan selection signals; and control means for controlling the drive circuit in a manner such that an interval between two scan selection signals which are continuously applied to the same scanning electrode is set to a predetermined period smaller than the full screen scanning period.

DESCRIPTION OF THE PREFERRED EMBODIMENTS

A. Signal Transfer Scheme

Figure 1:
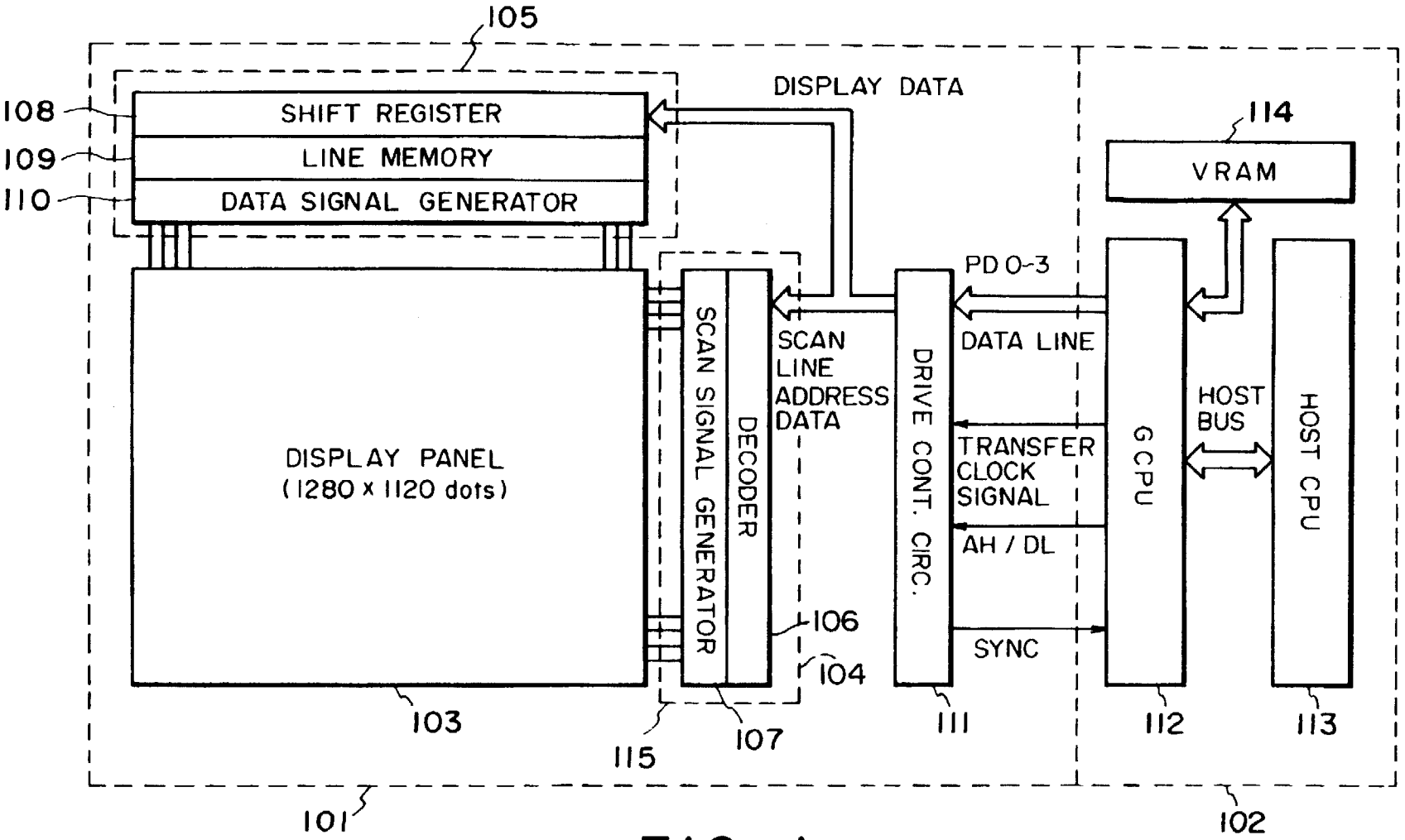
FIG. 1 is a block diagram of a liquid crystal display apparatus and a graphic controller.
Figure 2:
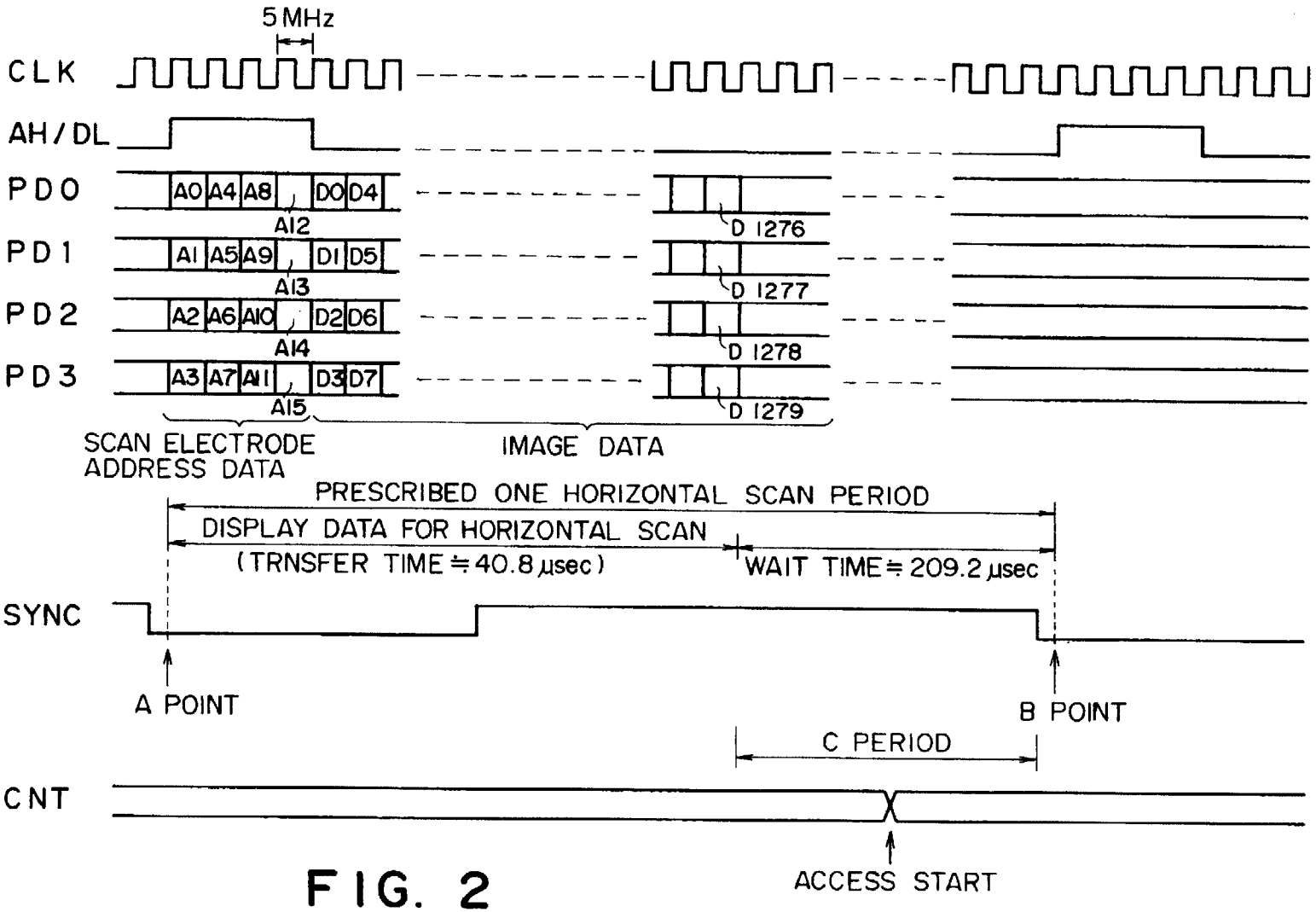
FIG. 2 is a time chart showing time correlation for image data communication between the liquid crystal display apparatus and the graphic controller.

FIG. 1 is a block diagram showing an arrangement of a ferroelectric liquid crystal display apparatus 101 and a graphic controller 102 provided in an apparatus body of, e.g., a personal computer as a source of supplying display data. FIG. 2 is a time chart for communication of image data.

A display panel 103 comprises a matrix electrode structure composed of 1120 scanning electrodes and 1280 data electrodes respectively disposed on a pair of glass plates and subjected to an aligning treatment, and a ferroelectric liquid crystal disposed between the glass substrates. The scanning electrodes (lines) and data electrodes (lines) are connected to a scanning line drive circuit 104 and a data line drive circuit 105, respectively.

Hereinbelow, the operation will be explained with reference to the figures. The graphic controller 102 supplies scanning line address data for designating a scanning line and image data (PD0–PD3) on the scanning line designated by the address data to a display drive circuit 104/105 (composed of a scanning line drive circuit 104 and a data line drive circuit 105) of the liquid crystal display apparatus 101. In this embodiment, the image data comprising the scanning line address data and the display data are transferred through the same transmission line, so that it is necessary to differentiate the above-mentioned two types of data. For the differentiation, a signal AH/DL is used. The AH/DL signal at a high level means scanning line address data, and the AH/DL signal at a low level means display data.

In the liquid crystal display apparatus 101, the scanning line address data are extracted from transferred image data PD0–PD3 by a drive control circuit 111 and then supplied to the scanning line drive circuit 104 in synchronism with a time for driving a designated scanning line. The scanning line address data are inputted to a decoder 106 in the scanning line drive circuit 104, and a designated scanning line in the display panel 103 is driven by a scanning signal generating circuit 107 with the aid of the decoder 106. On the other hand, the display data are introduced to a shift register 108 in the data line drive circuit 105 and shifted by a unit of 4 pixel data based on a transfer clock signal. When the shift of display data for one horizontal scanning line is completed by the shift register 108, the display data for 1280 pixels are transferred to a line memory disposed in parallel, memorized for a period of one horizontal scanning and are supplied to the respective data lines as display data signals through a data signal generating circuit 110.

Further, in this embodiment, the drive of the display panel 103 in the liquid crystal display apparatus 101 is not synchronized with the generation of the scanning line address data and display data in the graphic controller 102, so that it is necessary to synchronize the apparatus 101 and 102 at the time of image data transfer. A signal SYNC is in charge of the synchronization and is generated in the drive control circuit 111 in the liquid crystal display apparatus 101 at each one horizontal scanning period. The graphic controller 102 always monitors the SYNC signal, and transfers image data when the SYNC signal is at a low level and does not effect transfer after completing transfer of image data for one horizontal scanning line when the SYNC signal is at high level. More specifically, referring to FIG. 2, the graphic controller 102 immediately sets the AH/DL signal at high level and starts transfer of image data for one horizontal scanning line when it detects that the SYNC signal is at low level. The drive control circuit 111 in the liquid crystal display apparatus 101 set to the SYNC signal at high level during the image data transfer period. When the writing in the display panel 103 is completed after a prescribed one horizontal scanning period, the drive controller circuit (FLCD controller) 111 returns the SYNC signal to the low level so that it can receive image data for a subsequent scanning line.

More specifically, scanning electrode address data for addressing scanning electrodes and image data are supplied from the graphic controller 102 to the control circuit 111 through four signal lines PD0, PD1, PD2 and PD3. In this embodiment, scanning electrode address data (A0, A1, A2, . . . , A11) and image data (D0, D1, D2, D3, . . . , D1278, D1279) are transferred respectively through the same transmission signal lines PD0–PD4, so that it is necessary to differentiate the scanning electrode address data and the image data. In this embodiment, a discriminating signal AH/DL is used. The AH/DL signal at a high level means scanning electrode address data, and the AH/DL signal at a low level means image data. The AH/DL signal also contains a meaning of a transfer-initiation signal for transfer of display data.

When scanning electrode address data are supplied to the scanning electrode drive circuit 107 and image data are supplied to the data electrode drive circuit 105, the scanning electrode address data A0–A11 and the image data D0–D1279 are serially supplied through the signal lines PD0–PD3. It is necessary to provide a circuit for distributing the scanning electrode address data A0–A11 and the image data D0–D1279 or extracting the scanning electrode address data A0–A11. This operation is performed by the control circuit 111. The control circuit 111 extracts the scanning electrode address data A0–A11 supplied through the signal lines PD0–PD3, temporarily stores the data and supplies the data to the scanning electrode drive circuit 104 in a horizontal scanning period for driving a designated scanning electrode. The scanning electrode address data A0–A11 are supplied to the decoder 106 in the scanning electrode drive circuit 104 and select a scanning electrode 12C through the decoder 106.

On the other hand, the image data D0–D1279 are supplied to the shift register 108 in the data electrode drive circuit 105 and separated into image data D0–D1279 for pixels corresponding to the data electrodes (1280 lines) while being shifted for 4 pixels each by transfer clock signals CLK. When a shifting operation of the data for one horizontal scanning line is completed by the shift register 108, 1280 bits of the image data D0–D1279 in the shift register 108 are transferred to the line memory 109 and memorized therein in a horizontal scanning period. Further, in this embodiment, the drive of the display panel 103 and the generation of the scanning electrode address data A0–A11 and image data D0–D1279 in the graphic controller 102 are not synchronized, so that it is necessary to synchronize the control circuit 111 and the graphic controller 102 at the time of display data transfer. For this purpose, the synchronizing signal SYNC is generated in the control circuit for each horizontal scanning.

The signal SYNC is associated with the signal AH/DL. The graphic controller 102 always watches the signal SYNC to transfer display data when the signal SYNC is LOW and does not effect transfer after transfer of data for one horizontal scanning when the signal SYNC is HIGH. More specifically, referring to FIG. 2, at an instant when the signal SYNC is turned LOW, the AH/DL signal is turned HIGH at a point A and then the control circuit 111 returns the SYNC signal to HIGH during the display data transfer period. Then, at a point B which is one horizontal scanning period counted from the point A, the SYNC signal is returned to LOW. If the graphic controller 102 successively transfers display data at the point B, i.e., if a subsequent scanning electrode is driven, the AH/DL signal is again turned HIGH to start the transfer. Whole area refresh drive or whole display picture (area) scanning drive is performed in this embodiment, so that the drive is continuously effected line-sequentially.

The above-mentioned one horizontal scanning period (corresponding to one scanning selection period) is prescribed depending on the characteristic of the ferroelectric liquid crystal and the driving method in consideration also of optimum driving conditions. In this embodiment, the one horizontal scanning period was set to about 250 usec at room temperature so that the frame frequency was about 10 Hz. Further, the transfer clock CLK frequency was 5 MHz, and the transfer time of the scanning electrode address data and image data was about 40.8 usec, and the waiting time shown in FIG. 2 was 209.2 usec. The control signal CNT is a control signal for generating a desired driving waveform. This is supplied from the control circuit 111 to the respective drive circuits 104 and 105. The time for outputting CNT is the same as the time for outputting the scanning electrode address data A0–A11 from the control circuit 111 to the scanning electrode drive circuit 104 and also the same as the time for transferring the image data in the shift register 108 to the line memory 109.

The time for outputting the CNT signal is switched at a point which is after the completion of the transfer time (40.8 μsec) from the low level-starting point (A point) of the SYNC signal and one horizontal scanning period counted from the access starting point for the previous line. In this embodiment, a C period set between the termination of the transfer time and the point (B) of a subsequent signal turning low is determined at constant.

The above communication is effect between the drive circuits 104 and 105, and also between the graphic controller 102 and the control circuit 111, and the display panel is driven according to the above time-sequence.

B. Display Data Processing

Figure 3:
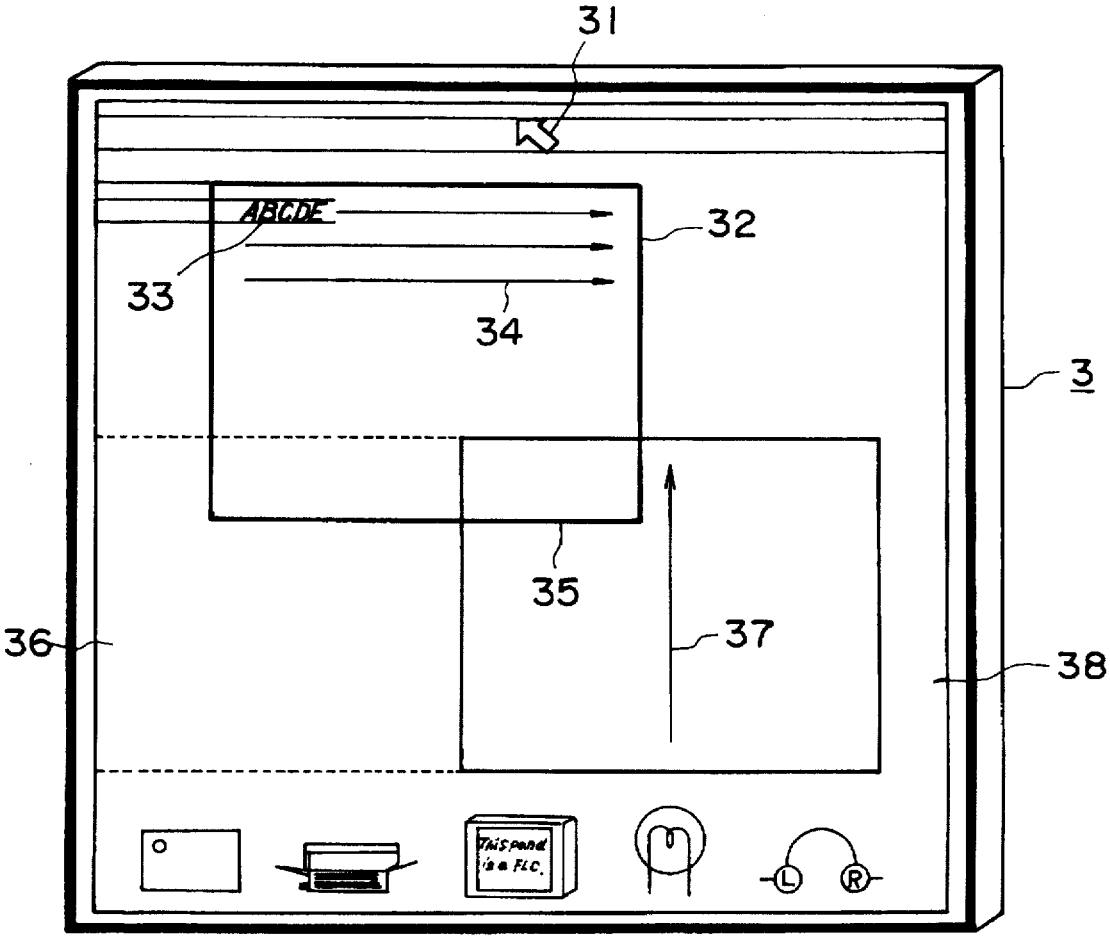
FIG. 3 is an illustrative view of a display picture schematically showing a plurality of graphic events.

FIG. 3 shows a display picture 3 when it is faced to a plurality of display demands caused for displaying display data according to multi-windows and a multi-task system.

Display demand 31: To move a mouse font or cursor smoothly in an oblique direction.

Display demand 32: To select a window as an active picture area and display it so as to overlap an already displayed window in front of the latter.

Display demand 33: To insert characters based on inputs from a key board.

Display demand 34: To move an already displayed character in the direction of an arrow.

Display demand 35: To change a display of an overlapping area.

Display demand 36: To display a non-active window.

Display demand 37: To effect a scroll display of the non-active window.

Display demand 38: To effect a whole area scanning display (or refresh).

The following Table 1 shows the priority levels of displaying graphic events corresponding to the above-mentioned display demands 31–38.

TABLE 1

| Graphic event | Drive mode | Display priority level | Write operation |
|---|---|---|---|
| 31 Mouse moving display | Partial rewriting | Highest level | |
| 32 Active window area ON | | | Logical access area |
| 33 Insertion display of characters | Partial rewriting | Second level | |
| 34 Moving display of characters | Partial rewriting | Third level | |
| 35 Overlapping area display change | | | Logical VRAM operation |
| 36 Non-active window area ON | | | Logical access area |
| 37 Non-active window area scroll display | Partial rewriting | Fourth level | |
| 38 Whole area scanning display | Multi-field refresh | Lowest level | |

In the above Table, "Partial rewriting" refers to a drive scheme wherein only the scanning lines in a partial rewriting region is scanned; "Multi-field refresh" refers to a one-frame scanning scheme wherein one frame is scanned according to a multi-interlaced scanning mode using N fields (N=2, 4, 8, . . . , $2^N$) (described in U.S. patent application Ser. No. 271,240 and European Patent Appl. No. 88118766.0.) "Display priority levels" are prescribed in advance so as to put a greater weight on the operation performance of a man-machine interface in this embodiment. Accordingly, the graphic even 31 (mouse moving display) is placed at the highest priority level, and then the graphic events 33, 34, 37 and 38 are placed at priority levels descending in that order. Further, "Write operation" refers to an internal write operation in the graphic processor.

The reason why the mouse moving display is allotted the highest display priority level, is that a pointing device like a mouse is expected to reflect the operator's intention most quickly (on a real-time basis) in the computer. The next important graphic event is an input of characters from the key board. This is generally buffered so that its priority is lower than the mouse while it still requires a high real-time characteristic. The refresh of a picture in a window as a result of the input from the key board is not necessarily required to be performed strictly simultaneously as the key-in and a higher priority is allotted to the key-in row. Relative display of scrolling in another window and an overlapping area are changed by a particular system setting and are naturally encountered in a multi-task operation. In this embodiment, the scrolling is set to be performed so as to slip under the active window.

Figure 4:
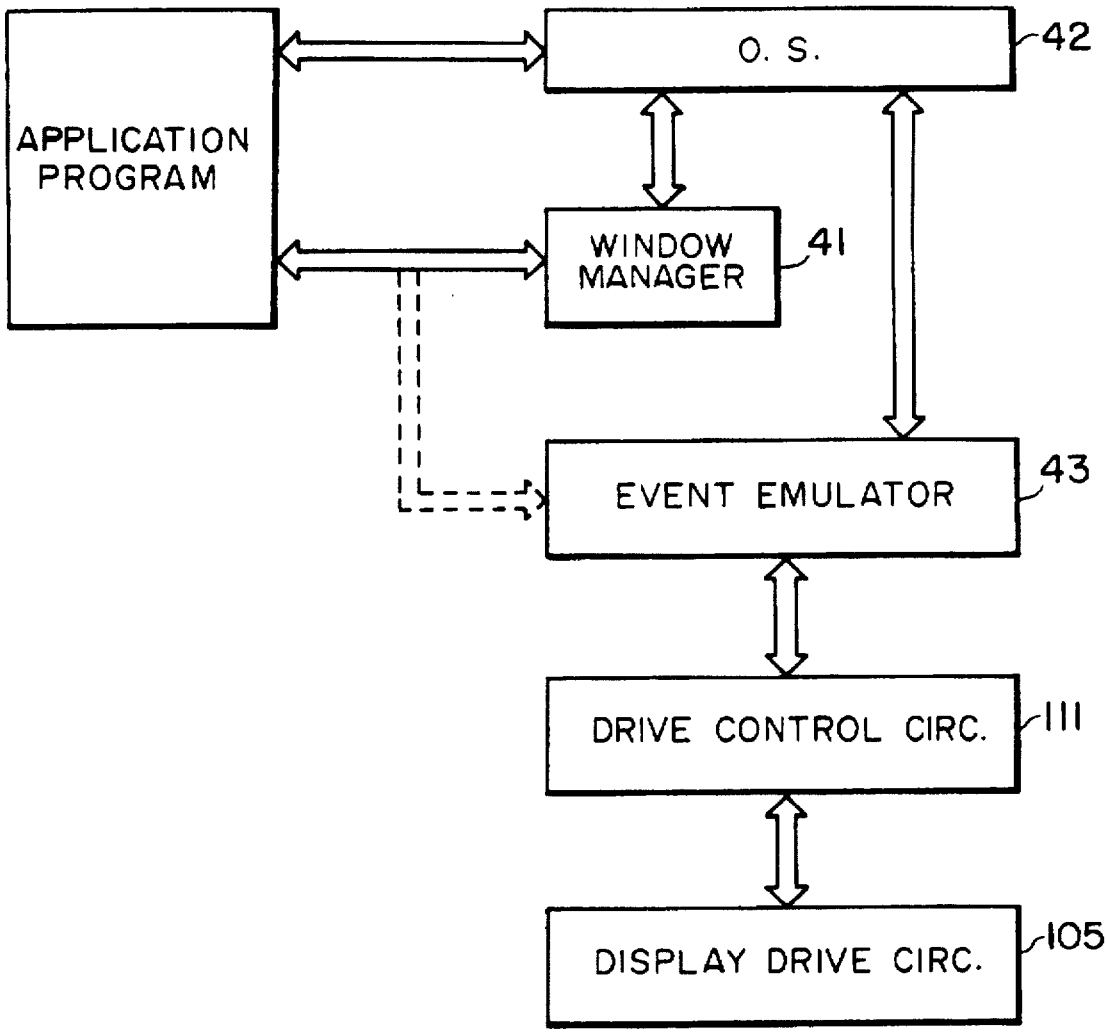
FIG. 4 is a block diagram showing a display control program used in the invention.

In the present invention, a picture display control program as shown in FIG. 4 deals with the display demands 31–38 received from the exterior through a communication sequence as shown and controls the transfer of image data to the ferroelectric liquid crystal display apparatus (FLCD) 101 shown in FIG. 1. The picture display control program, when at least one demand of rewriting an already displayed image occurs, judges the rewriting region and writing in VRAM (storage memory for image data) required for the rewriting based on the priority level thereof, and selectively transfers image data to the display apparatus 101 while taking a synchronization with the display apparatus 101.

In the communication sequence shown in FIG. 4, a window manager 41 and an operating system (OS) 42 are used. The operating system 42 may be "MS-DOS" (trade name; available from Microsoft, U.S.A.), "XENIX" (do), "UNIX" (trade name, available from AT & T, U.S.A.), or "OS/2" (trade name, available from Microsoft, U.S.A.). The window manager 41 my be "MS-Windows" ver. 1.03 or ver. 2.0 (trade name, available from Microsoft, U.S.A.), "OS/2 Presentation Manager" (trade name, Microsoft, U.S.A.), "X-Window" in the public domain, or "DEC-Window" (trade name, available from Digital Equipment, U.S.A.). The event emulator 43 also shown in the figure may be a set of "MS-DOS & MS-Windows" or "UNIX & X-Window".

According to the partial rewriting scheme or mode used in the present invention, only the scanning lines in a partial rewriting region are scanned, a high-speed partial rewriting can be effected because of a memory characteristic of FLCD. Further, in the present invention, it is assumed that not so many display data in a whole picture are required to be rewritten instantaneously and at high speeds by a computer system. For example, a rate of 30 Hz or less is sufficient for displaying data from a pointing device such as a mouse, and a higher speed cannot be followed by human eyes. Similarly, smooth scrolling (scrolling of each line) requiring the highest speed display cannot be followed either if it is too fast. Scrolling is rather performed not for each line but for each character or each integrated block. In a computer system, scrolling is frequently used at the time of programming or sentence edition or revision, and the object thereof is to effect a moving display from one row to another rather than a strictly smooth scroll, so that a moving speed of about 10 rows/sec is practically of no problem.

In case where a mouse font is composed of 32×32 dots and the partial rewriting scan thereof is effected by the non-interlaced mode in an FLC, a simple calculation would provide a response speed as follows:

$$32 \text{ lines} \times 100\ \mu\text{sec/line} = 3.2 \text{ msec} \rightarrow 312 \text{ Ha.} \quad \text{[Eq.1]}$$

On the other hand, a row scrolling at a rate of 10 rows/sec corresponds to a refresh speed at a frequency of 10 Hz according to the non-interlaced mode. A frequency of 10 Hz is considered to provide a noticeable flicker in a strict sense, but it practically provides no problem because the entire picture moves with a row as a unit and display data more appeals to eyes than flicker. As a result, the number of scanning lines which can be driven according to the non-interlaced mode in case of a row-unit basis scrolling is given by the following equation.

$$(1/10 \text{ Hz})/100\ \mu\text{sec} = 1000 \text{ lines} \quad \text{[Eq.2]}$$

Based on the arrangement and data format comprising image data accompanied with scanning line address data and by adopting communication synchronization using a SYNC signal as shown in FIGS. 1 and 2, the present invention realizes a liquid crystal display apparatus driven based on a partial rewriting scanning algorithm as described below.

Image data are generated in the graphic controller 102 in an apparatus body and transferred to the display panel 103 by signal transfer means shown in FIGS. 1 and 2. The graphic controller 102 principally comprises a CPU (central processing unit, hereinafter referred to as "GCPU") 112 and a VRAM (video-RAM, image data storage memory) 114 and is in charge of management and communication of image data between a host CPU 113 and the liquid crystal display apparatus (FLCD) 101. The control method according to the present invention is principally realized in the graphic controller 102.

Figures 2, 9:
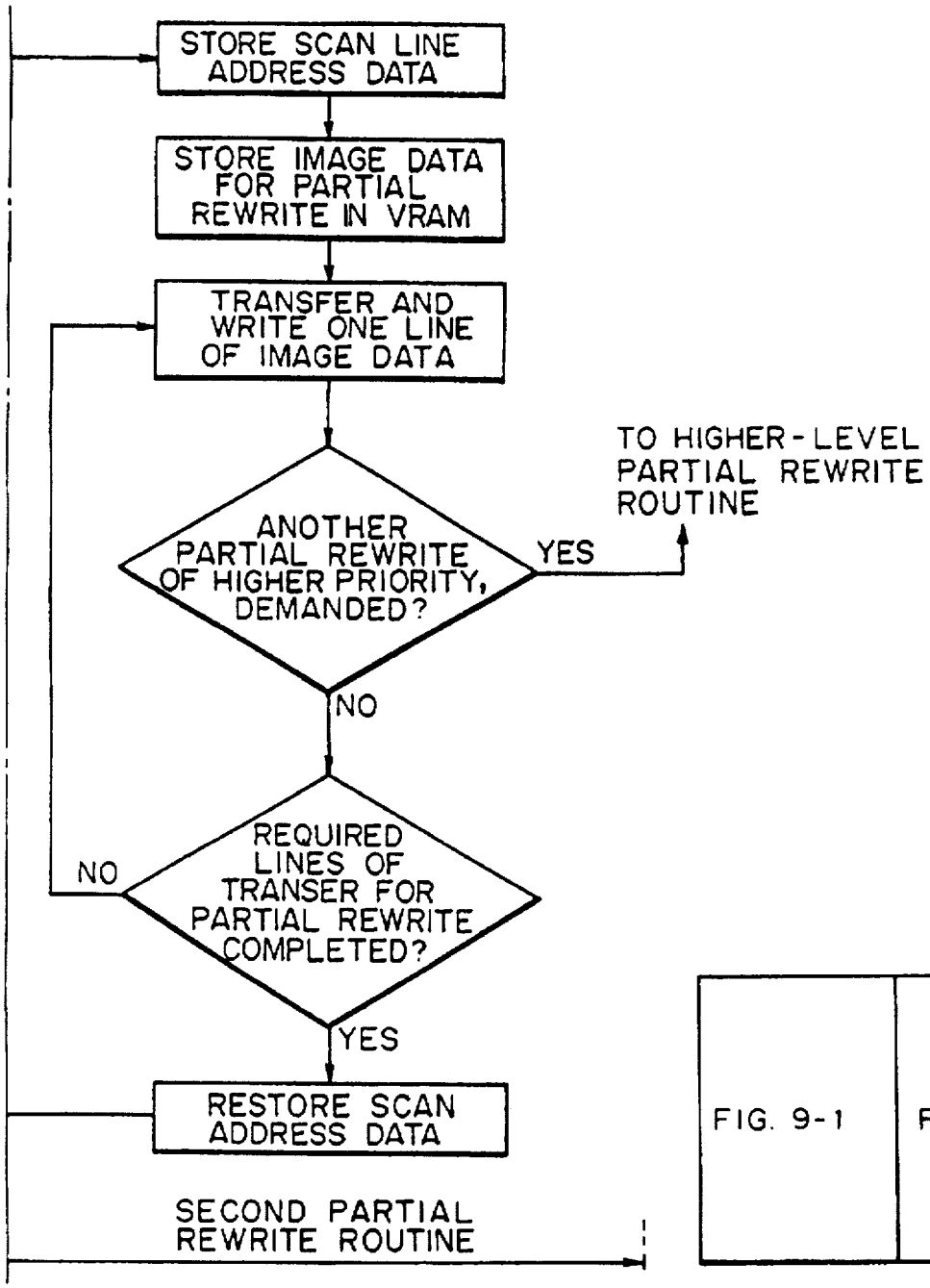
FIG. 9 is a sequence diagram showing algorithm for partial rewriting used in the invention.
Figure 9:
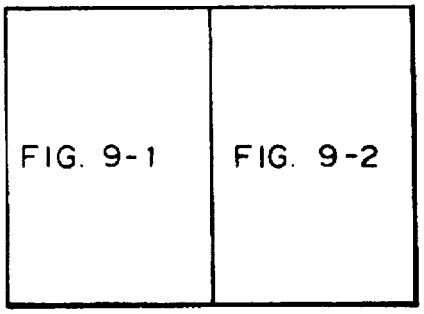
Figures 1, 9:
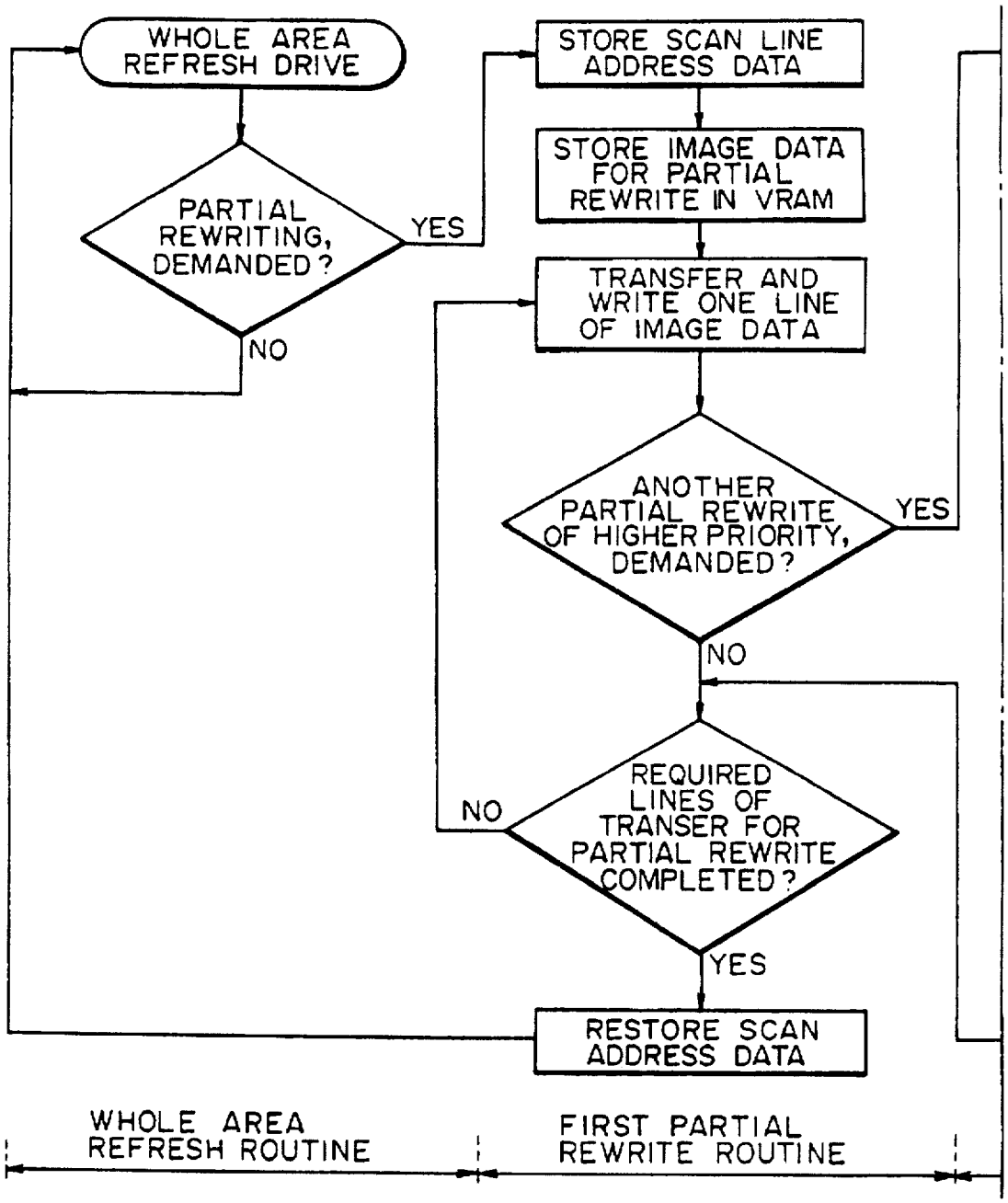

FIG. 9 shows a partial rewriting algorithm according to the present invention. Display data (as from a pointing device or pop-up menu) requiring partial rewriting on the FLCD 101 are registered in advance in the GCPU 112, and if partial rewriting is judged to be necessary with respect to data from the host CPU 113, a partial rewriting routine is started. In the partial rewriting routine, scanning line address data and the number of scanning lines immediately before the branching are first sheltered (stored) in a register preliminarily provided in GCPU 112. When the image data necessary for rewriting from the host CPU 113 are stored in VRAM 114 in the graphic controller 102, GCPU 112 manages the storage starting address and storage, region, and the image data are transferred to the liquid crystal display apparatus 101 according to the signal transfer scheme shown in FIGS. 1 and 2 for the partial rewriting operation.

Figure 10:
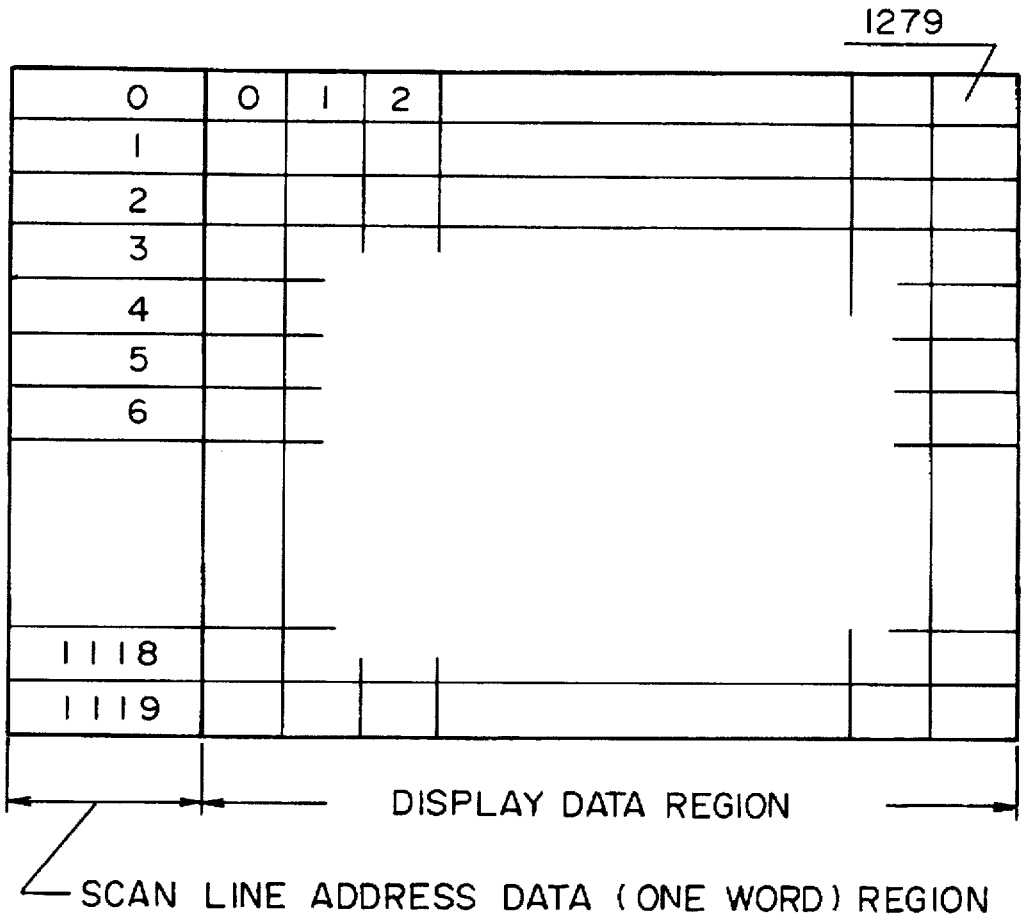
FIG. 10 is a schematic data map showing scanning address data and display data in VRAM used in the invention.

In order to formulate a data format comprising image data accompanied with scanning line address data, the scanning line address data is disposed in. VRAM 114 as shown in FIG. 10. VRAM 114 is divided into two regions, one of which is allocated as a scanning line address data region and the other of which is allocated as a display data region. The image data is disposed laterally for one line and the scanning line address data is disposed in advance at the leading head (left side) of the image data for one line, so that the data bits on the VRAM 114 correspond to the pixels on the display panel 103 one-to-one. GCPU 112 reads out the data from the left side of VRAM 114 for each line as a unit and supplies the same to the liquid crystal display apparatus 101 and so formulates a data format comprising image data led by the scanning line address data.

The transfer to the liquid crystal display apparatus 101 is performed for each line as a unit under the continual management by GCPU 112 of the scanning line address data and the number of transferred scanning lines mapped on the VRAM 114. After each transfer of one line, it is judged whether another partial rewriting demand has occurred. If a second partial rewriting has been demanded at that time and the image data demanded for partial rewriting have a lower display priority level than that of rewriting data under processing, the transfer for a subsequent scanning line is performed as it is. If the new image data has a higher priority level, the data transfer of the first rewriting data under way is interrupted and branched into a second partial rewriting routine. In the second partial rewriting routine, similarly as in the first partial rewriting routine, scanning line address data and the number of scanning lines immediately before the branching are first sheltered in a register provided in advance in GCPU 112. Thereafter, the second partial rewriting data is stored on VRAM 114 and is supplied to the display apparatus 101 for one line each as a unit. After the transfer for each line, it is checked whether another partial rewriting of a higher display priority has been demanded or not. If not demanded, the image data for the whole area for the second partial rewriting is continually transferred, and thereafter, the first rewriting routine is resumed based on the scanning line address data and the number of scanning lines which have been sheltered at the time of branching into the second partial rewriting routine. In the first rewriting routine, the transfer of the remaining image data is continued while it is checked for each line of transfer whether another rewriting of a higher priority level has been demanded or not. After the completion of the transfer of the total image data, the scanning line address data and the number of scanning lines sheltered at the outset are restored, and an ordinary refresh routine is resumed.

Figure 11:
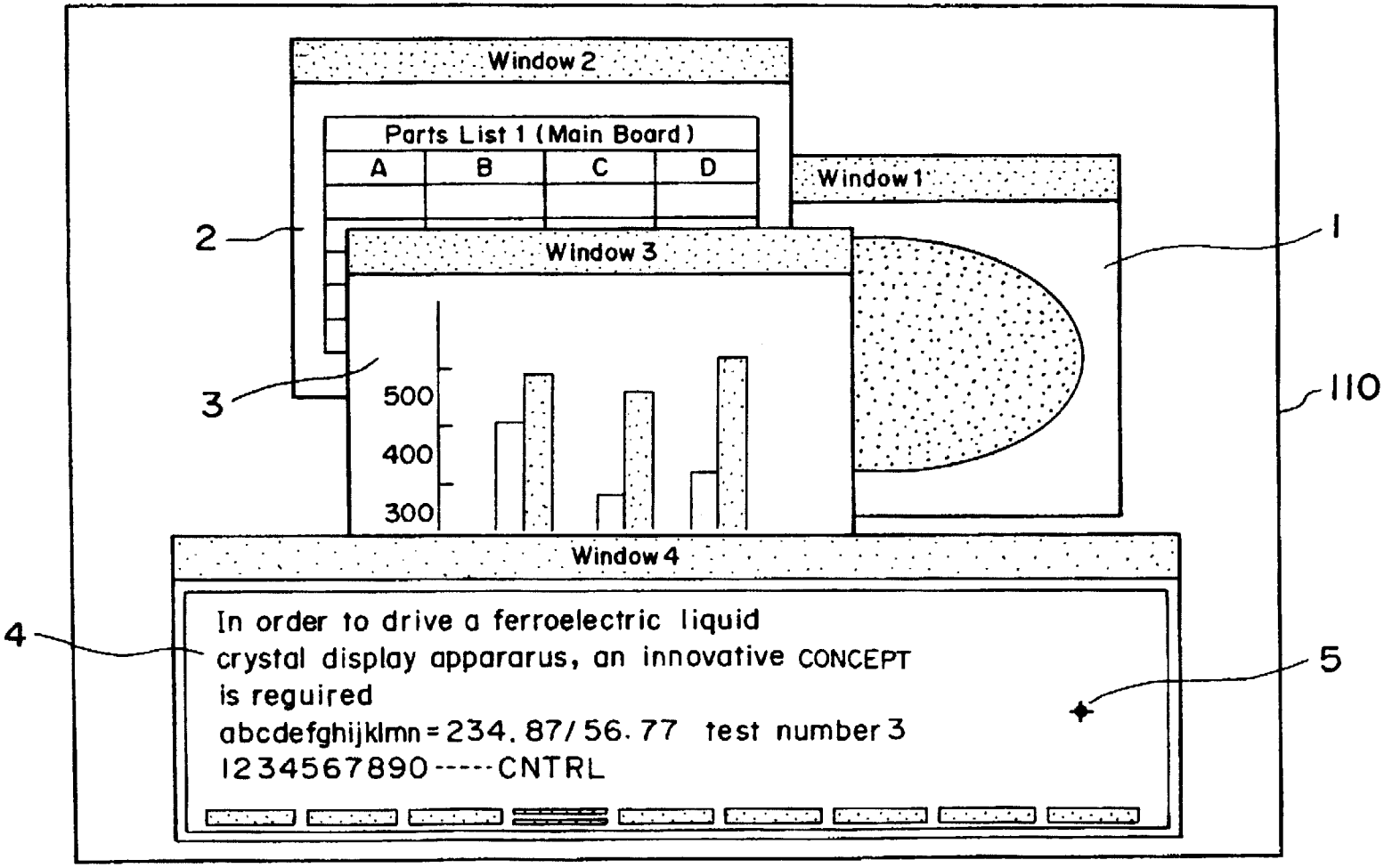
FIG. 11 is an illustration of a multi-window display picture according to an embodiment of the invention.

FIG. 11 shows another example of a multi-window display picture 110. A window 1 shows a picture of a categorized total expressed in a circle. A window 2 shows the categorized total at the window 1 expressed in a table. A window 3 shows the categorized total at the window 1 expressed in a bar graph. A window 4 shows a picture under preparation of sentences. A mouse font 5 given from a mouse as a pointing device is also shown. Herein, it is assumed that the pictures at the windows 1–3 are in a still picture state, the window 4 is used for an editorial display including smooth scrolling, insertion, deletion or regional transfer of words or paragraphs, and the mouse font 5 is moved therein. Then, the smooth scrolling and the mouse font movement constitute image data requiring partial rewriting scanning of a ferroelectric liquid crystal display apparatus 101. For example, if all of 1120 scanning lines constituting a whole picture area are scanned at a rate of one horizontal scanning time=80 μsec, the resultant frame frequency is lowered to about 10 Hz, so that it is impossible at all to follow an ordinary movement of a mouse font (≧30 Hz). By adopting the algorithm of the present invention to provide the partial rewriting by the mouse movement with a higher priority level than that of the editorial display in the window 4, it is possible to immediately start the partial rewriting routine by the mouse movement by branching even if the mouse is moved during the scrolling. In this instance, the time required for the branching into the mouse partial rewriting routine is within one horizontal scanning period at the longest. For example, as shown by [Eq. 1] above, the required time for writing a mouse font on the display panel 103 is 3.2 msec if the font size is composed of 32×32 dots. The scroll operation is stopped during the time, which however is sufficiently short and hardly affects the scroll speed. After the mouse font writing, the partial rewriting scanning in the window 4 is resumed, but if the mouse is moved again, the branching into the mouse partial rewriting routine is effected to start writing of the mouse font. Thus, in a low-frequency drive display having a memory characteristic like a ferroelectric liquid crystal display apparatus 101, it has become possible to realize a multi-window, multi-task display function by putting the most weight on the movement of a pointing device (mouse).

Figure 5:
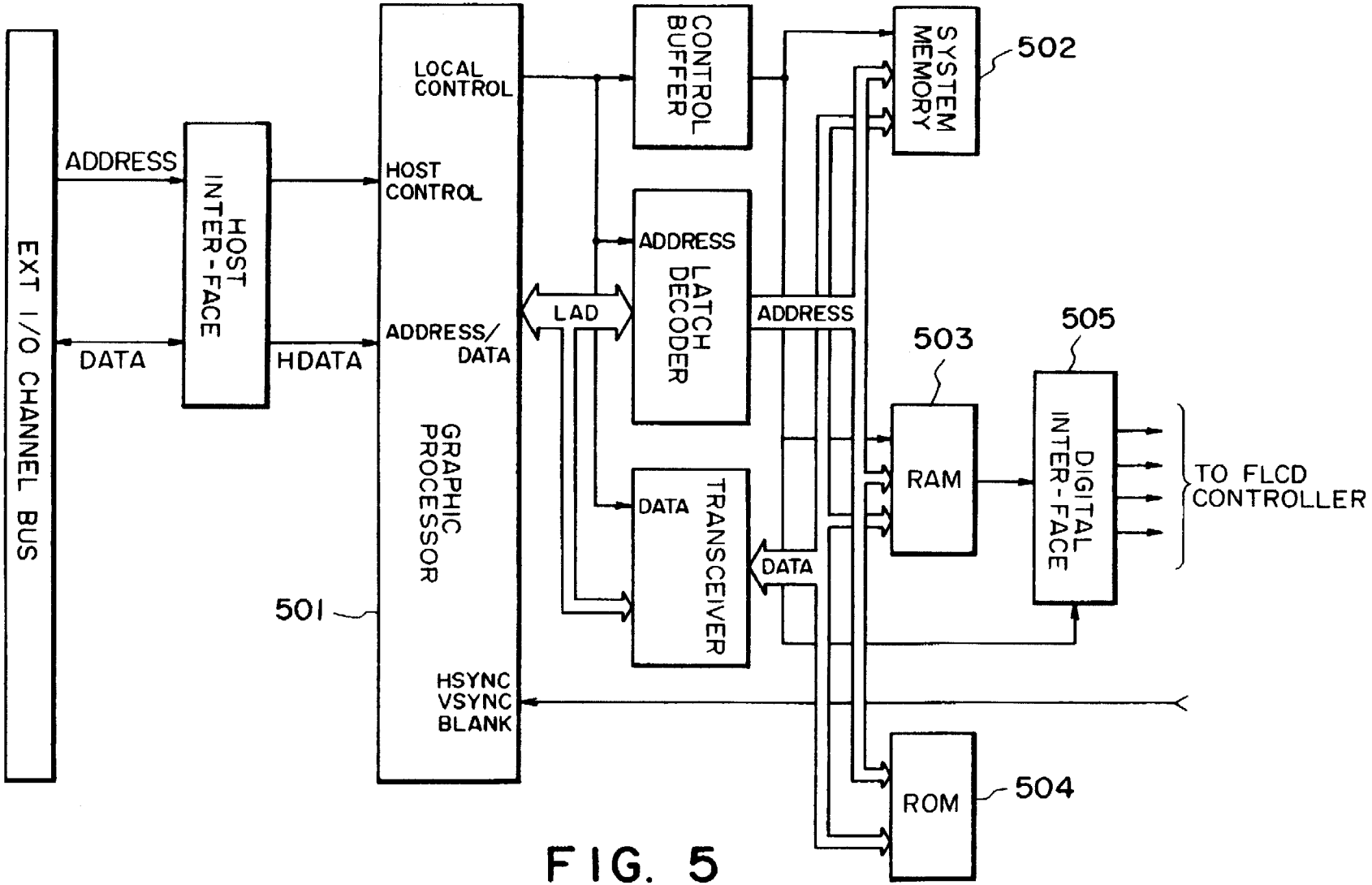
FIG. 5 is a block diagram of a graphic controller used in the invention.
Figure 6:
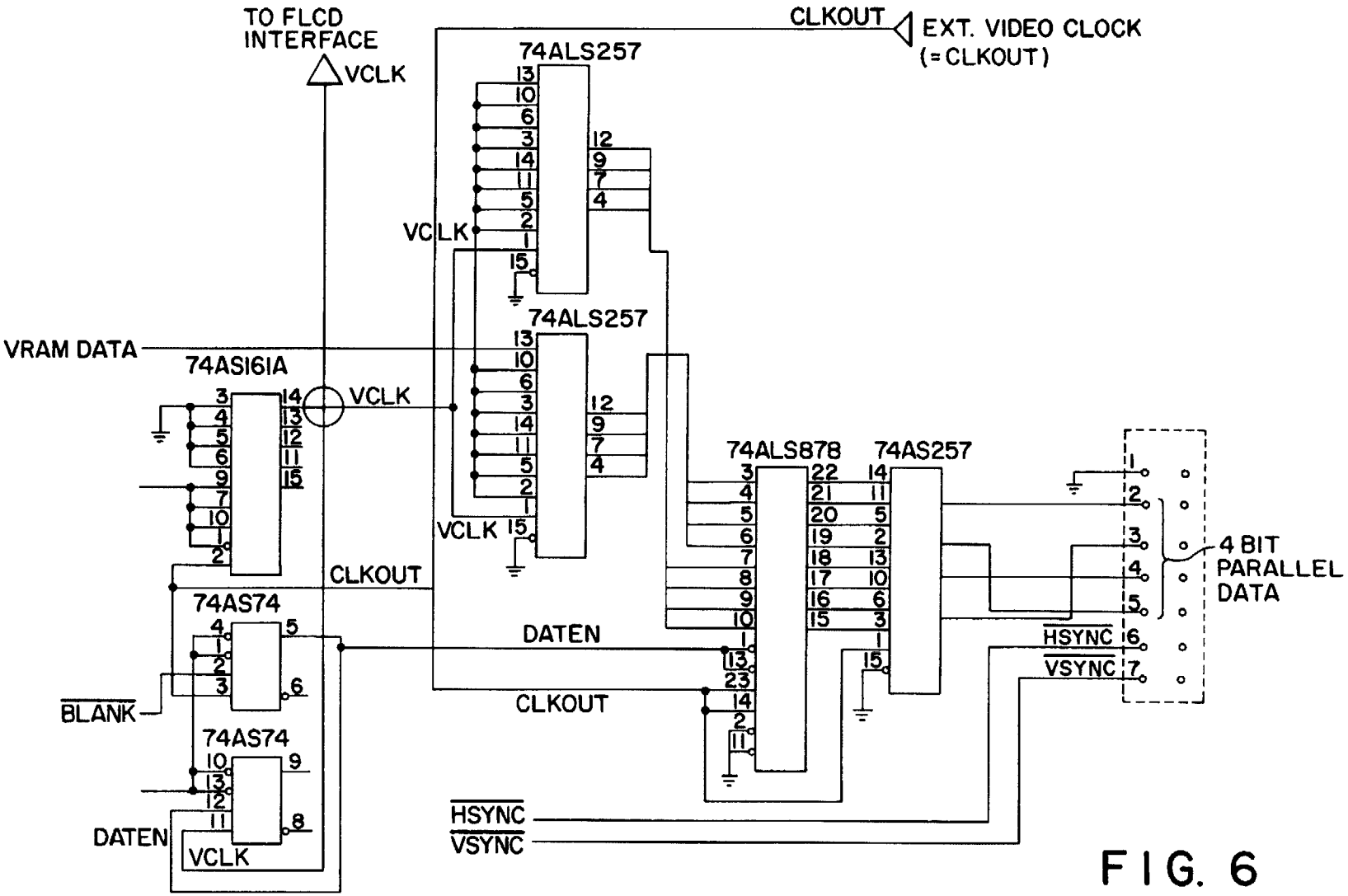
FIG. 6 is a block diagram of a digital interface.
Figure 7:
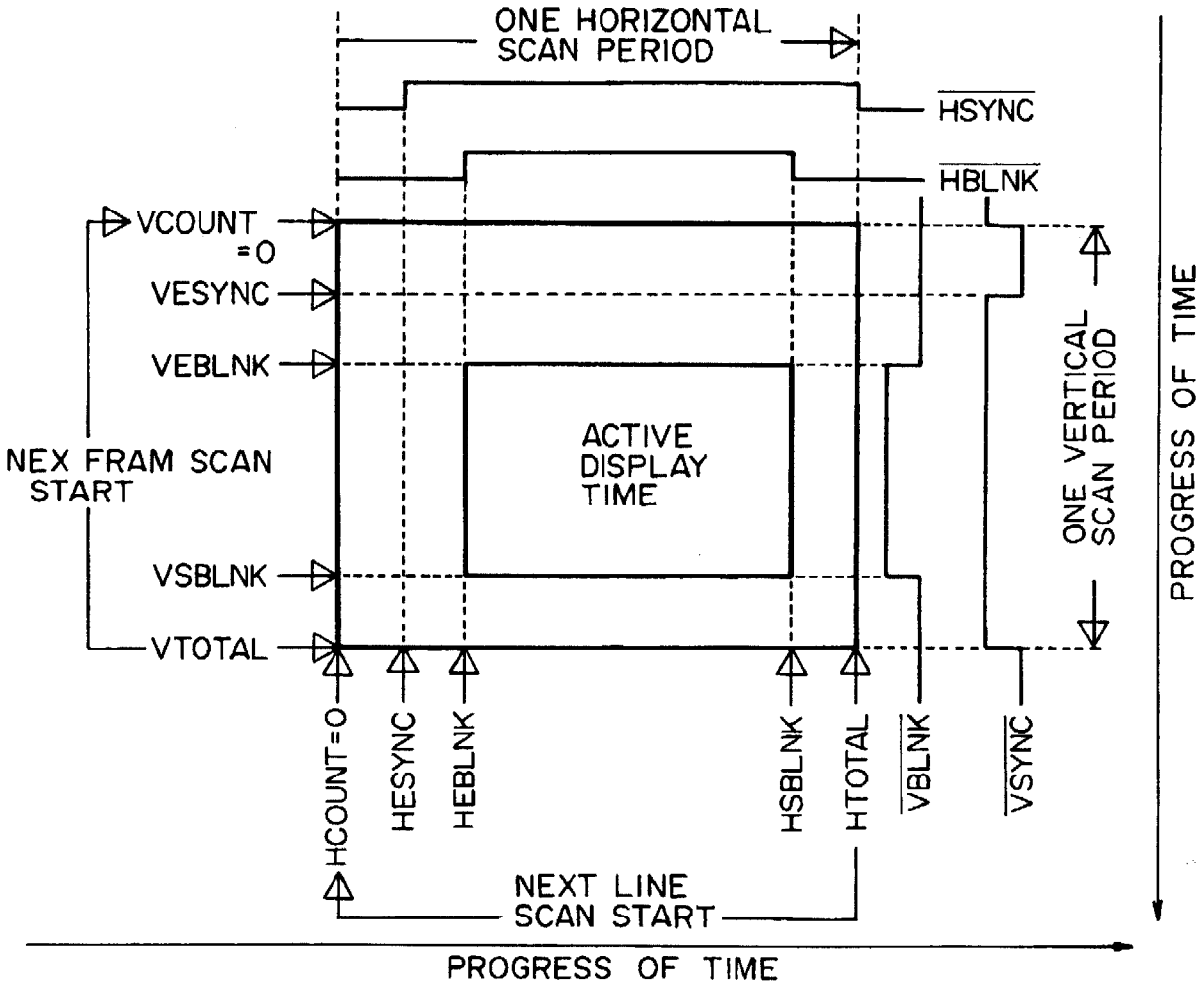
FIG. 7 is an interfacial time chart for a display drive apparatus used in the invention.
Figure 8:
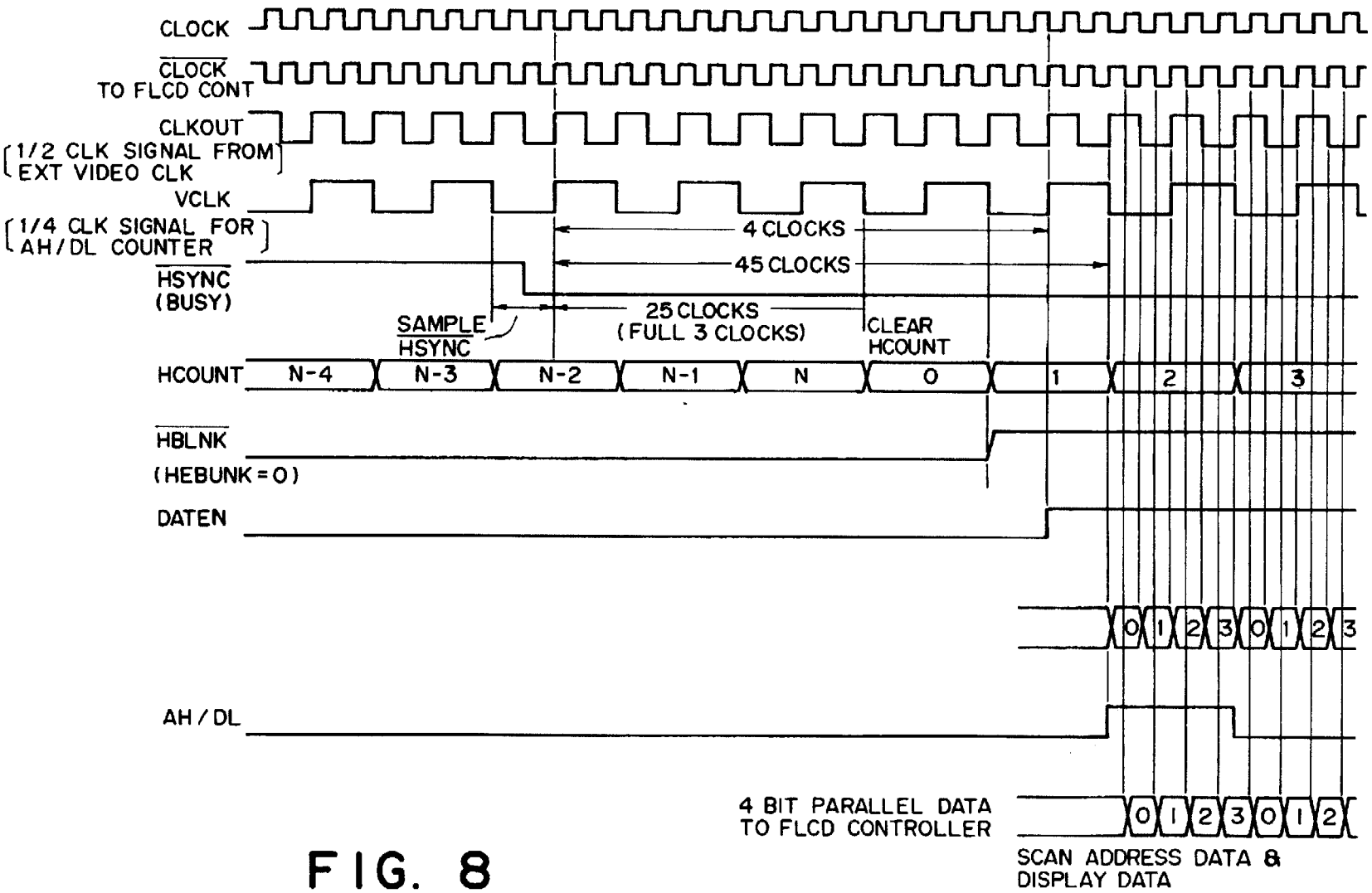
FIG. 8 is an interfacial time chart for an FLCD controller.

FIG. 5 is a block diagram of the graphic controller 102, FIG. 6 is a block diagram of the digital interface, and FIGS. 7 and 8 are time charts for internal data transfer.

A clear distinction of the graphic controller 102 used in the present invention is that the graphic processor 501 thereof has a system memory 502 for its exclusive use, and not only manages RAM 503 and RAM 504 but also effects the execution and management of writing instruction to RAM 503, and is further capable of independent programming with respect to data transfer from a digital interface 505 to the FLCD controller and management of driving FLCD.

The digital interface 505 shown in FIG. 6 takes a synchronization with the drive circuits 104 and 105 of the display panel 103 based on an external synchronizing signal HSYNC/VSYNC from FLCD controller 111 and in parallel therewith provides, at its final stage, 4 bits/clock pulses (data transfer clock signals) based on data in VRAM. FIG. 7 shows time relations for whole area rewriting of FLCD panel, and the parameters therein are the same as in FIG. 8 which is a time chart for data transfer.

First of all, the transfer of image data for one line is started when the signal $\overline{\text{HSYNC}}$ becomes active (low level in this case). The signal $\overline{\text{HSYNC}}$ is made low by FLCD controller 111 as data requirement from the panel 103 side. The data requirement from the panel 103 side is received by the graphic processor 501 shown in FIG. 5 and is processed therein according to the time chart shown in FIG. 8. Referring to FIG. 8, $\overline{\text{HSYNC}}$ representing the data requirement from the panel 103 is sampled for 1 cycle of an external video clock signal CLKOUT (in other words, the low period of VCLK which is actually supplied to the graphic processor 501 so that the processor 501 effects the sampling for the low period according the actual specification), and 2.5 pulses of VCLK thereafter, a horizontal counter HCOUNT is cleared. Then, parameters HEYSYN and HEBLNK in FIG. 7 are programmed to disable $\overline{\text{HBLNK}}$ (high) in FIGS. 7 and 8. A half pulse of VCLK thereafter, in the circuit shown in FIG. 6, DATEN is made active (high) as shown in FIG. 8, and a further half pulse thereafter (i.e., 4.5 pulses after the sampling of $\overline{\text{HSYNC}}$), data for a subsequent one line is transferred 4 bits by 4 bits from VRAM to FLCD controller 111.

As-shown at the lower right corner of FIG. 8, the high data transferred in this way is such that the scanning line address data (corresponding to the scanning line number) is first sent 4 bits by 4 bits and then the display data for one line are transferred. Correspondingly, in the FLCD controller 111, a signal AH/DL is used for discriminating the scanning line address data and the display data in such a way that a high AH/DL signal indicates the scanning line address data and a low AH/DL signal indicates the display data. Accordingly, in the FLCD, a scanning line is selected by the scanning line address data and the display data is written correspondingly. As a result, the FLCD is driven according to the non-interlaced mode if the scanning line address data sent from the graphic controller shown in FIG. 5 is increased one by one, according to an alternately interlaced mode if the address data is increased two by two, and according to an m-line multi-interlaced mode if the address data is increased by m-by-m. In this way, the drive of FLCD is controlled.

FLCD ordinarily requires about 100 μsec as a drive time for one scanning line. Now, if it is assumed that one scanning line drive time is 100 μsec and a minimum frequency not causing flicker is 30 Hz, the number of scanning lines in FLCD which can be driven without causing flicker in a still image can be calculated as follows:

According to the non-interlaced mode [Eq. 3]

$$(1/30\ \text{Hz})/100\ \mu\text{sec} \simeq 333\ \text{lines}$$

Alternately interlaced mode [Eq. 4]

$$(1/30\ \text{Hz}) \times 2/100\ \mu\text{sec} \simeq 666\ \text{lines}$$

M-line multi-interlaced mode [Eq. 5]

$$(1/30\ \text{Hz}) \times m/100\ \mu\text{sec} \simeq 333 \times m\ \text{lines}$$

According to our experiments, it has been confirmed that no flicker is observed even in a case of m=32.

$$(1/30\ \text{Hz}) \times 32/100\ \mu\text{sec} = 333 \times 32 = 10656\ \text{lines} \quad \text{[Eq. 6]}$$

This means that a display panel having 10656 scanning lines can be driven without flickering and a flat display panel having a high resolution not realized heretofore can be obtained though on the basis of calculation.

Incidentally, in FIG. 6, "74AS161A", "74AS74", "74ALS257","74ALS878" and "74AS257" refer to IC members and the numerics in the figure refer to pin numbers.

E. Display Scanning Scheme

In the present invention, the refresh drive may be performed by an interlaced scanning mode as described below, and the partial rewriting drive may be performed by a non-interlaced scanning mode. The partial rewriting drive is performed by "partial scanning line scan" wherein, in order to rewrite a partial region of the whole display picture area, a scanning selection signal is applied to scanning lines constituting only the partial region (rewriting region). Now, some explanation is added to the interlaced scanning mode which is generally used for the whole area refresh drive.

[Interlaced Scanning Mode]

A scanning selection signal is sequentially applied to the scanning electrodes with jumping or skipping of N lines apart ($N \geqq 1$, preferably $4 \leqq N \leqq 20$), in one vertical scanning period (corresponding to one field period), and one picture scanning (corresponding to one frame scanning) is effected by N+1 times of field scanning. In the present invention, it is particularly preferred that one vertical scanning is effected two or more scanning electrodes apart and scanning electrodes not adjacent to each other are selected (scanned) in at least two consecutive times of vertical scanning.

Figure 12A:
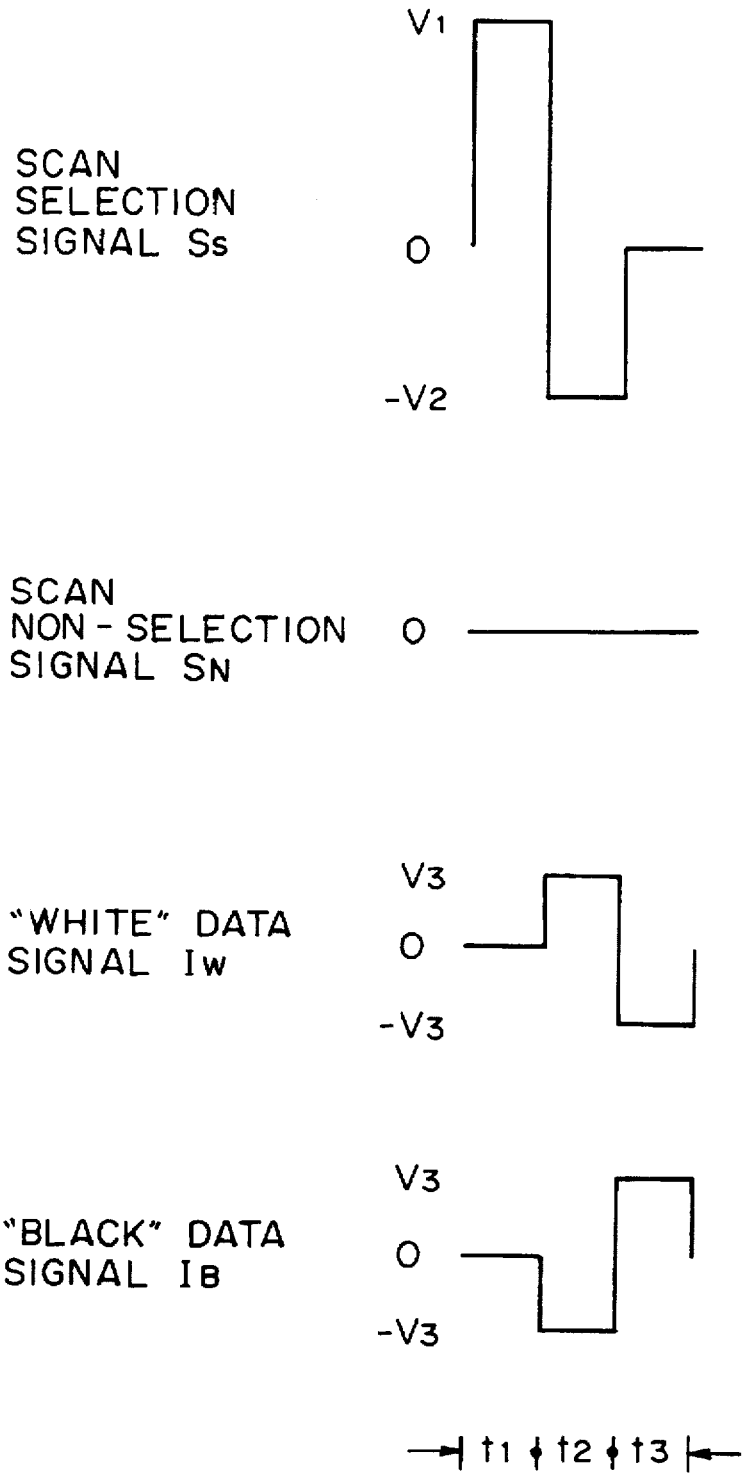
FIGS. 12A–12D and FIGS. 13A–13C respectively show a set of driving signal waveforms used in the invention.
Figure 12B:
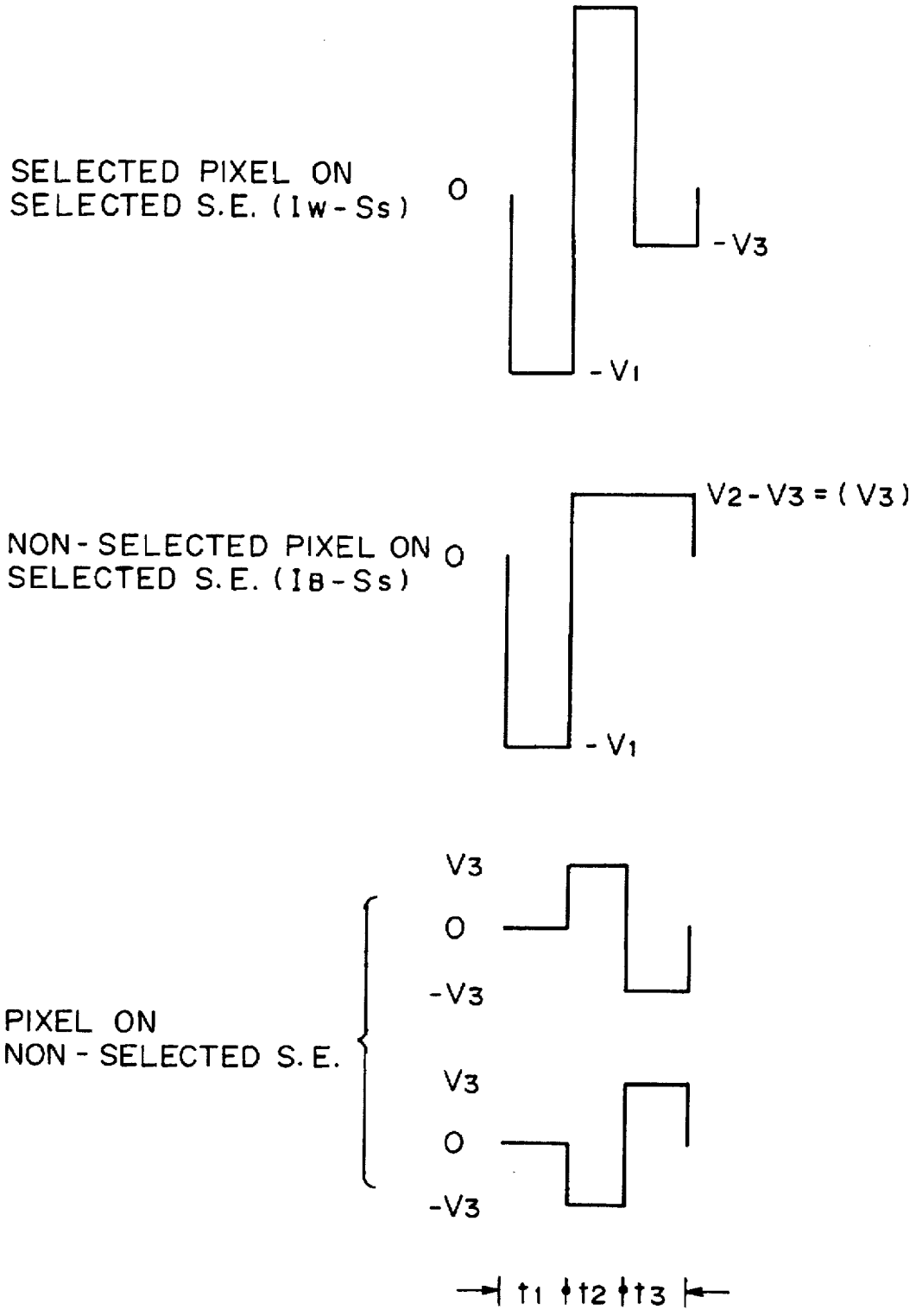

FIG. 12A shows a scanning selection signal $S_S$, a scanning non-selection signal $S_N$, a white data signal $I_W$ and a black data signal $I_B$. FIG. 12B shows a voltage waveform applied to a selected pixel among the pixels on a selected scanning electrode receiving a scanning selection signal (a voltage ($I_W$–$S_S$) applied to a pixel receiving a white data signal $I_W$), a voltage waveform applied to a non-selected pixel on the same selected scanning electrode (a voltage ($I_B$–$S_S$) applied to a pixel receiving a black data signal $I_B$), and voltage waveforms applied to two types of pixels on a non-selected scanning electrode receiving a scanning non-selection signal. According to FIGS. 12A and 12B, the pixels on a selected scanning electrode are simultaneously supplied with a voltage providing one orientation state of a ferroelectric liquid crystal to be erased into a black state based on such one orientation state of the ferroelectric liquid crystal (a pair of cross nicol polarizers are so arranged as to effect erasure into a black state in this embodiment, but it is also possible to arrange polarizers so as to cause erasure into a white state) in phase $t_1$ regardless of the kind of a data signal supplied. in a subsequent phase $t_2$, a selected pixel on the selected scanning electrode ($I_W$–$S_S$) is supplied with a voltage ($V_2$+$V_3$) providing a white state based on the other orientation state of the ferroelectric liquid crystal, and the other pixels on the selected scanning electrode ($I_B$–$S_S$) are supplied with a voltage ($V_2$–$V_3$=$V_3$) not changing the black state formed in the phase $t_1$. On the other hand, the pixels on a scanning electrode receiving the scanning non-selection signal are supplied with voltages $\pm V_3$ below the threshold voltage of the ferroelectric liquid crystal. As a result, in this embodiment, the pixels on the selected scanning electrode are written into either black or white through phases $t_1$ and $t_2$ and retain their states even when they are subsequently supplied with a scanning non-selection signal $S_N$.

Further, in this embodiment, in a phase $t_3$, a voltage of a polarity opposite to that of the data signal in the writing phase $t_2$ is supplied from a data electrode. As a result, a pixel at the time of scanning non-selection is supplied with an AC voltage to improve the threshold characteristic of the ferroelectric liquid crystal. Such a signal applied through a data electrode is called an auxiliary signal and is explained in detail in U.S. Pat. No. 4,655,561.

Figure 12C:
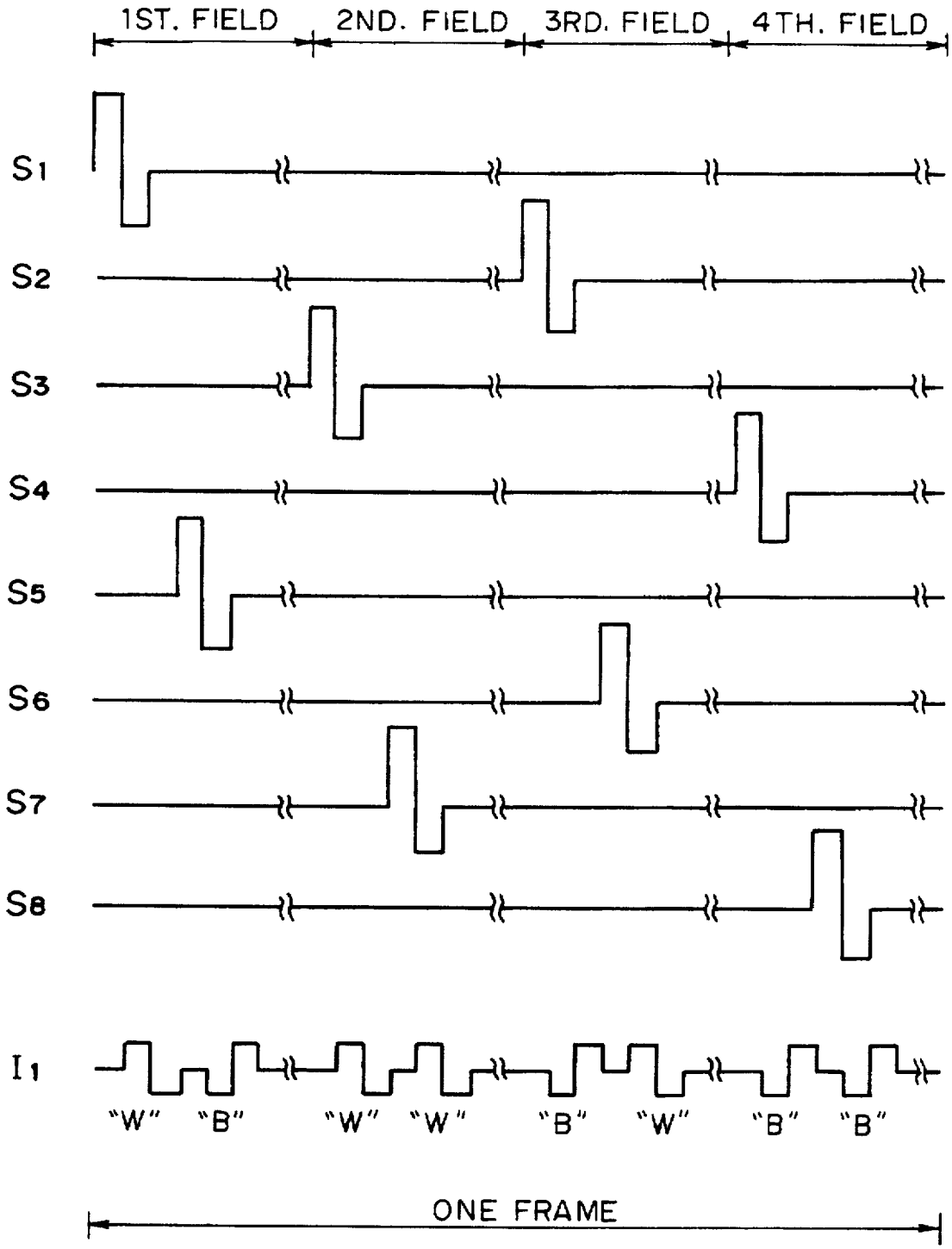

FIG. 12C is a time chart of voltage waveforms for providing a certain display state. In this embodiment, a scanning selection signal is applied to the scanning electrodes three lines apart in one field, and one frame scanning (one picture scanning) is effected by 4 consecutive times of field scanning so that no adjacent pair of scanning electrodes are supplied with a scanning selection signal together in 4 consecutive fields. As a result, a scanning selection period ($t_1$+$t_2$+$t_3$) can be set longer as required at a low temperature, so that occurrence of flickering attributable to scanning drive at a low frame frequency can be remarkably suppressed even at such a low frame frequency as 5–10 Hz, for example. Further, by applying a scanning selection signal so that non-adjacent scanning electrodes are selected in consecutive four field scannings, an image flow can be effectively solved.

Figure 12D:
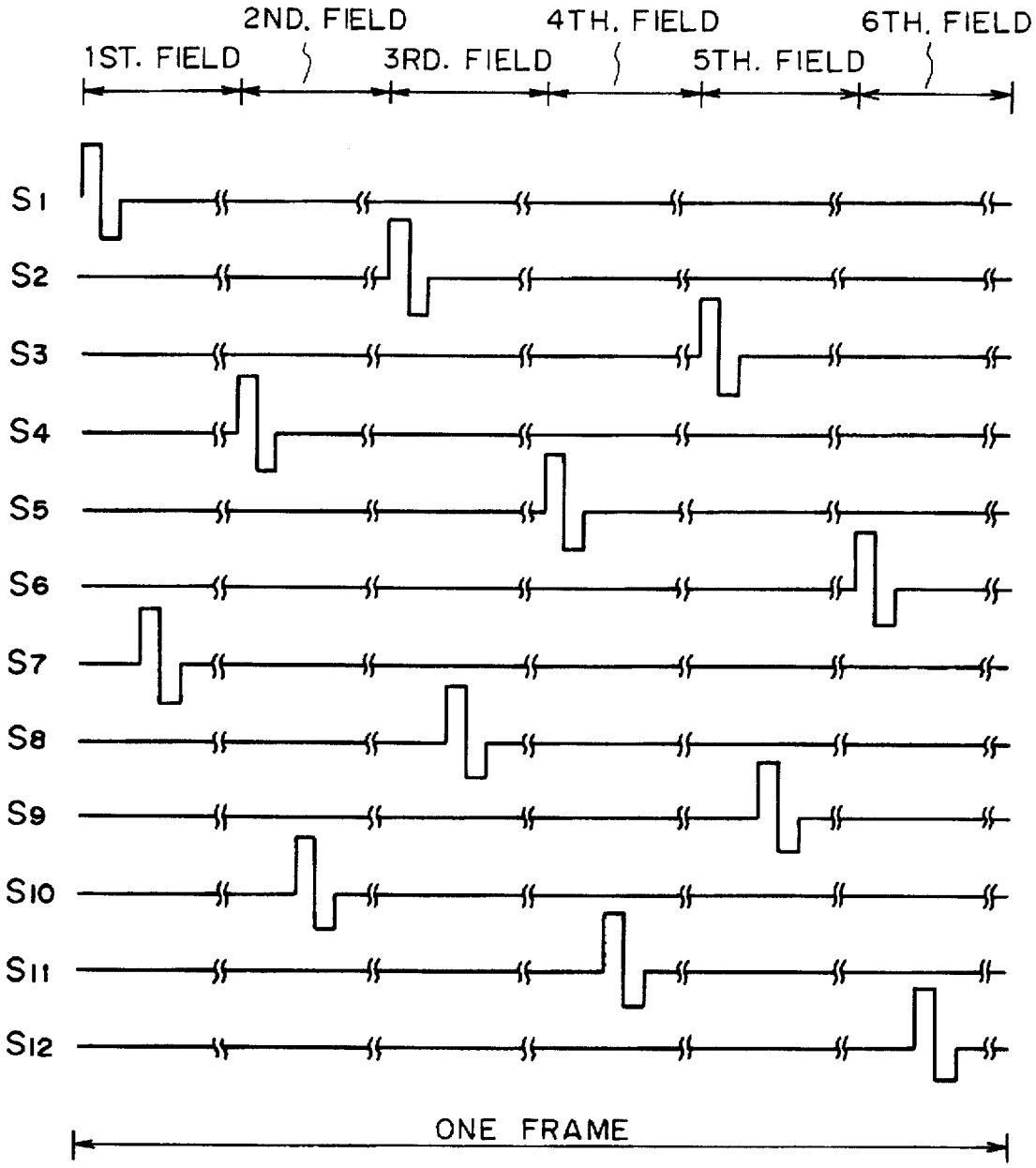

FIG. 12D shows an embodiment using driving waveforms shown in FIG. 12A. In this embodiment, the scanning electrodes are selected 5 lines (scanning electrodes) apart so that non-adjacent scanning electrodes are selected in 6 times of consecutive field scanning.

Figure 13A:
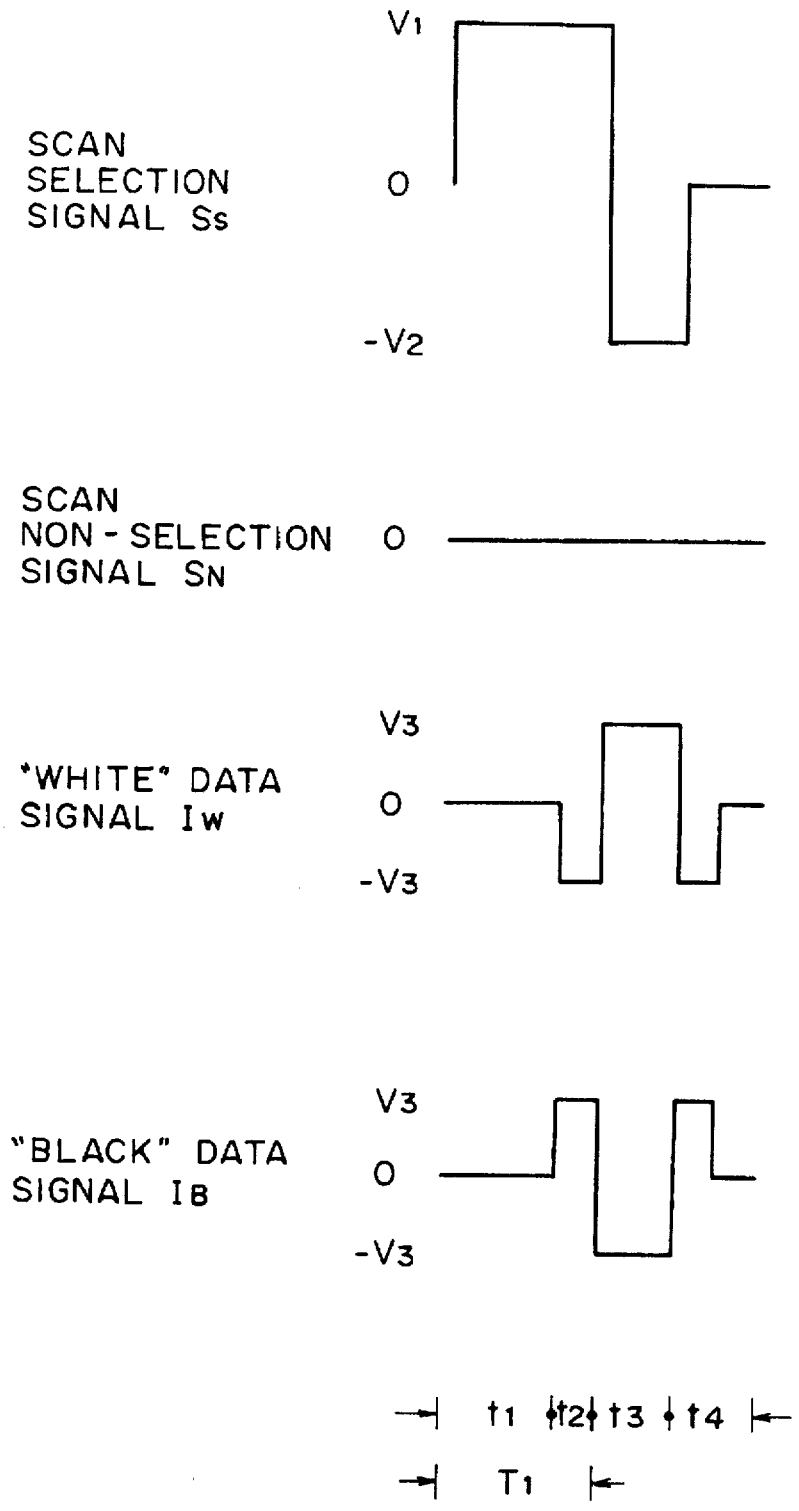
Figure 13B:
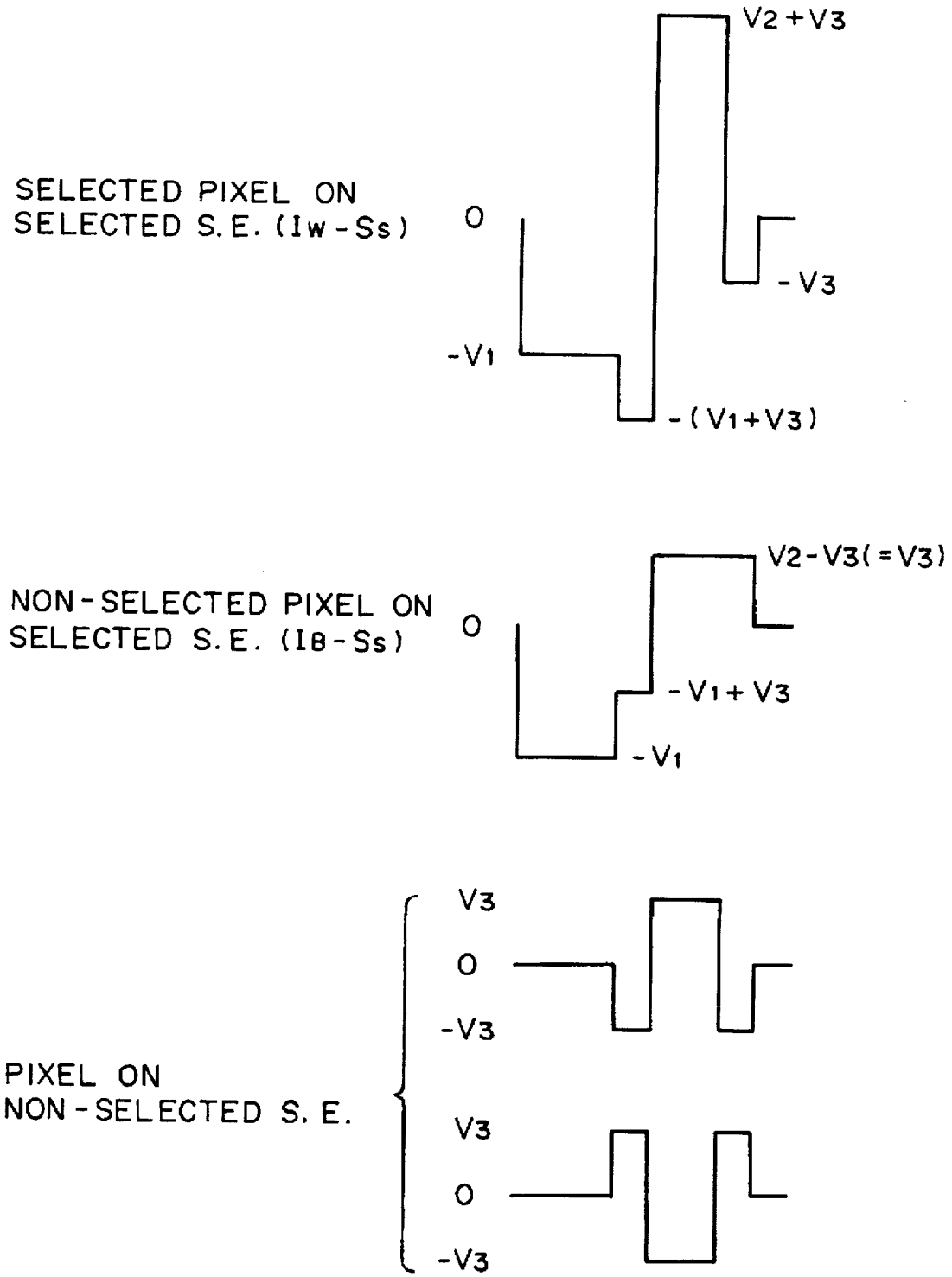

FIGS. 13A and 13B show another driving embodiment used in the present invention.

According to FIGS. 13A and 13B, on a scanning electrode receiving a scanning selection signal $S_S$, all or a prescribed part of the pixels are simultaneously supplied with a voltage for erasure into a black state in phase $T_1$ (=$t_1$+$t_2$) regardless of the types of data signals, and in phase $t_3$, a selected pixel ($I_W$–$S_S$) is supplied with a voltage ($V_2$+$V_3$) for inversion-writing into a white state and the other pixels ($I_B$–$S_S$) are supplied with a voltage ($V_2$–$V_3$=$V_3$) not changing the black state formed in the phase $T_1$. Further, phases $t_2$ and $t_4$ are provided for applying auxiliary signals so as to apply an AC voltage to the pixels at the time of non-selection, similarly as in the previous embodiment.

Figure 13C:
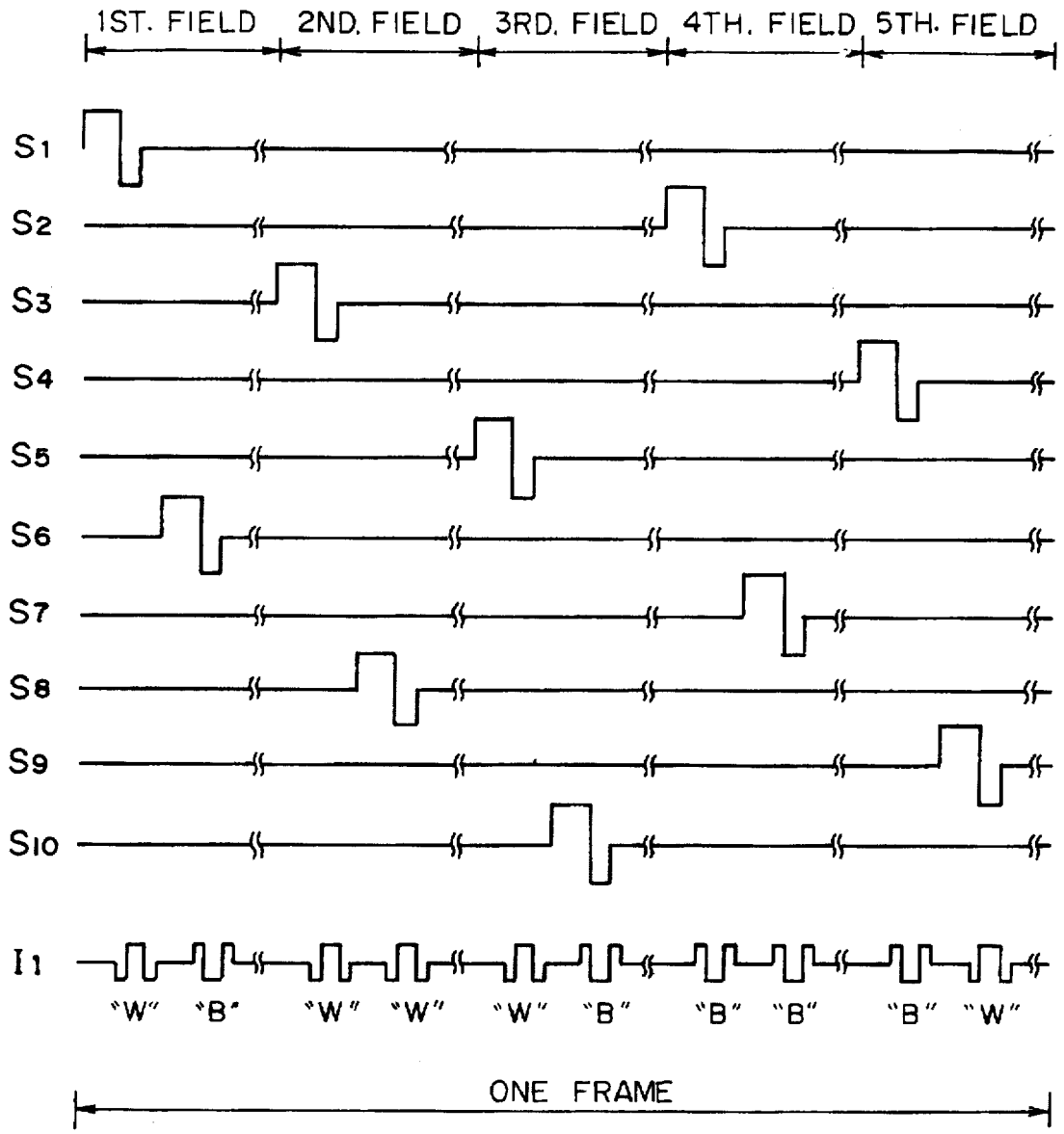

FIG. 13C is a time chart of voltage waveforms for providing a certain display state. According to the embodiment shown in FIG. 13C, a scanning selection signal is applied to the scanning electrodes with jumping of 4 lines apart in one field so as to complete one frame scanning in 5 fields. Also in this embodiment, non-adjacent scanning electrodes are supplied with a scanning selection signal in consecutive 5 times of field scanning.

The present invention is not restricted to the above-described embodiments but can be effected generally in such a manner that a scanning selection signal is applied to the scanning electrodes with jumping of one or more lines apart, preferably 4–20 lines apart. Further, in the present invention, the peak values of the voltages $V_1$, $-V_2$ and $\pm V_3$ may be set to satisfy the relation of $|V_1|=|-V_2|>|\pm V_3|$, preferably $|V_1|=|-V_2|\geqq 2|\pm V_3|$. Further, the pulse durations of these voltage signals may be set to generally 1 μsec–1 msec, preferably 10 μsec–100 usec, and may preferably be set to be longer at a lower temperature and shorter at a higher temperature.

F. Ferroelectric Liquid Crystal Device

Figure 14:
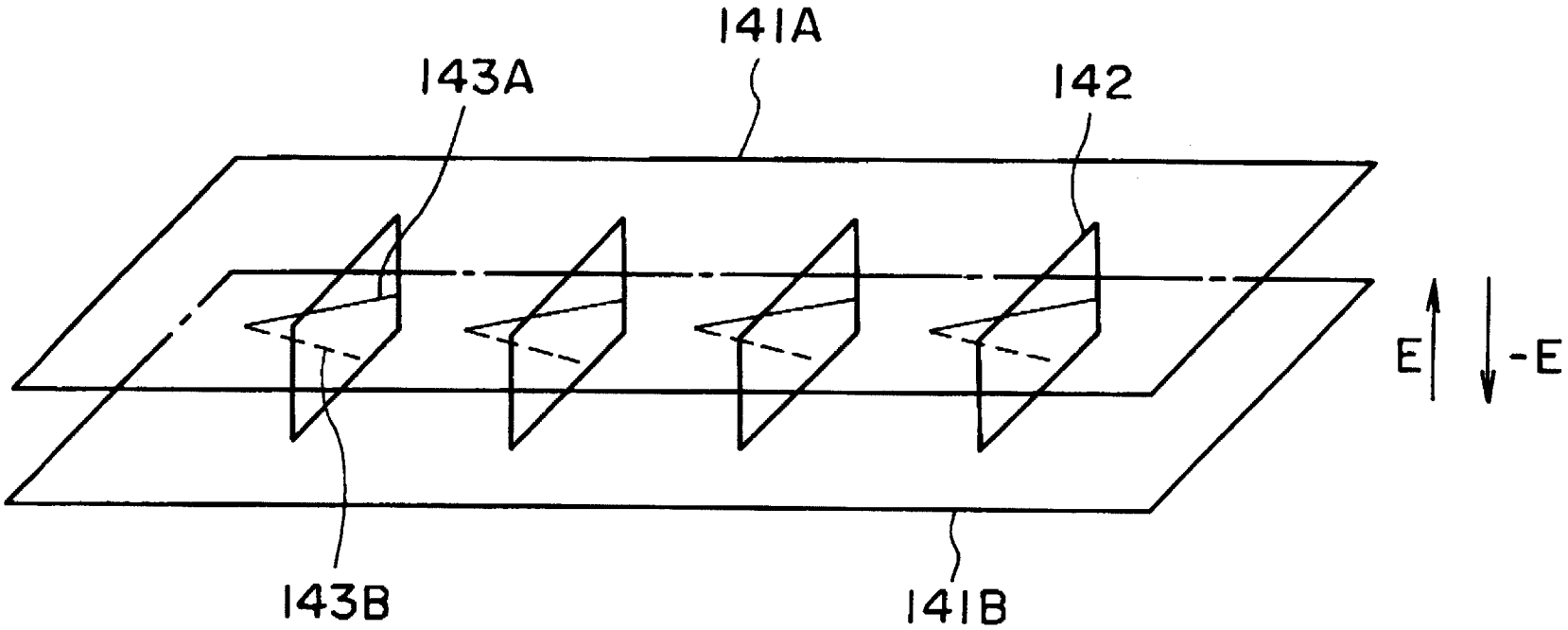
FIG. 14 is a schematic perspective view for illustrating an operation principle of a ferroelectric liquid crystal device.

FIG. 14 schematically illustrates an embodiment of a ferroelectric liquid crystal cell which comprises a pair of electrode plates (glass substrates coated with transparent electrodes) 141A and 141B and a layer of ferroelectric liquid crystal having molecular layers 142 disposed between and perpendicular to the electrode plates. The ferroelectric liquid crystal assumes chiral smectic C phase or H phase and is disposed in a thickness (e.g., 0.5–5 microns) thin enough to release the helical structure inherent to the chiral smectic phase.

When an electric field E (or –E) exceeding a certain threshold is applied between the upper and lower substrates 141A, 141B, liquid crystal molecules 133 are oriented to the electric field. A liquid crystal molecule has an elongated shape and shows a refractive anisotropy between the long axis and the short axis. Therefore, if the cell is sandwiched between a pair of cross nicol polarizers (not shown), there is provided a liquid crystal modulation device. When an electric field E exceeding a certain threshold is applied, a liquid crystal molecule 143 is oriented to a first orientation state 143A. Further, when a reverse electric field –E is applied, the liquid crystal molecule 143 is oriented to a second orientation state 143B to change its molecular direction. Further, the respective orientation states are retained as far as an electric field E or –E applied thereto does not exceed a certain threshold.

The ferroelectric liquid crystal device used in this embodiment may have a bistability or multistability so that the first stable state 143A and second stable state 143B may be symmetrical or unsymmetrical. As a result, the liquid crystal molecules tend to be oriented to either one of the orientation states or to another stabler third orientation state. The present invention is suitably applied to such a ferroelectric liquid crystal device having bistability or multistability and suitably applied to a ferroelectric liquid crystal device as disclosed by U.S. Pat. No. 4,367,924 or EP-A-91661.

Figure 15A:
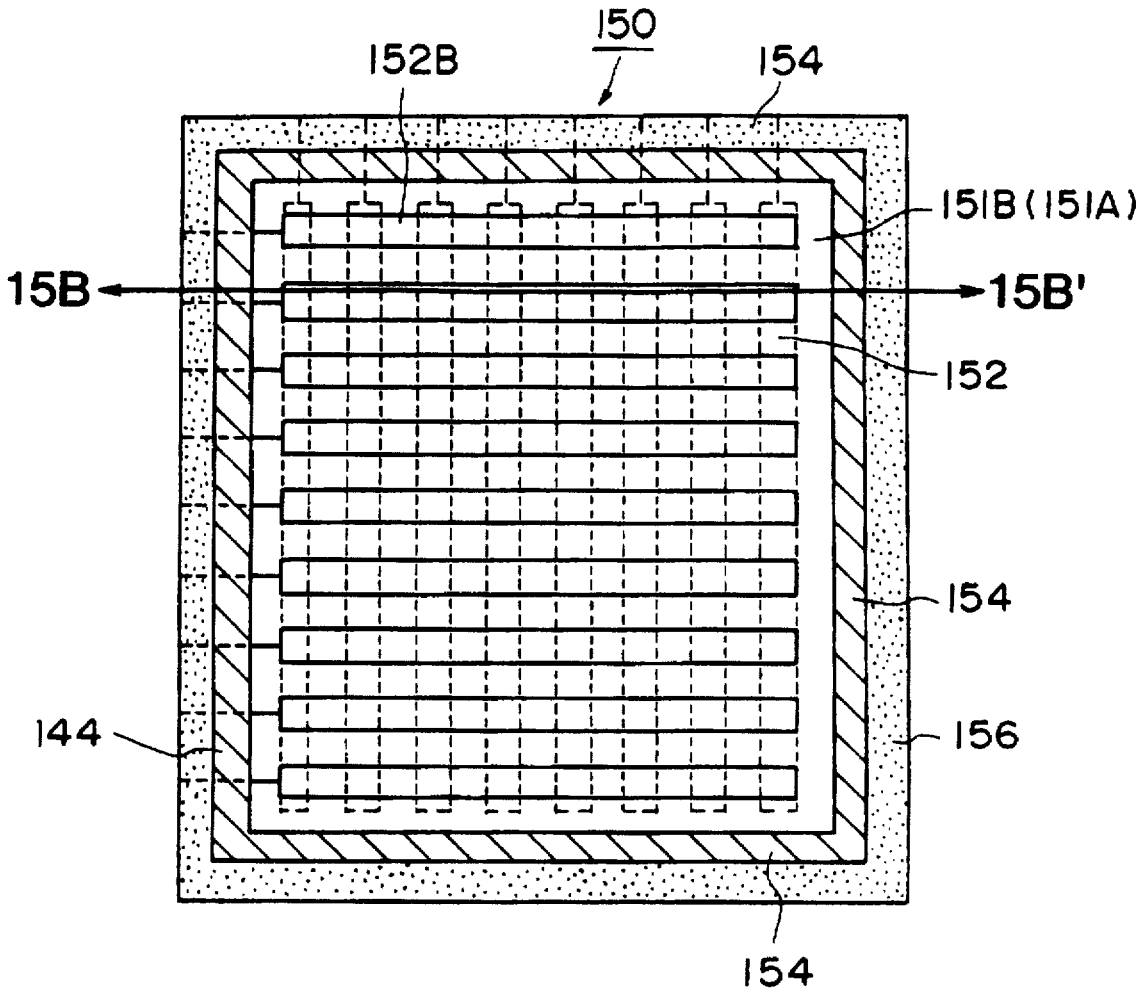
FIG. 15A is a schematic plan view of a ferroelectric liquid crystal device used in the invention.
Figure 15B:
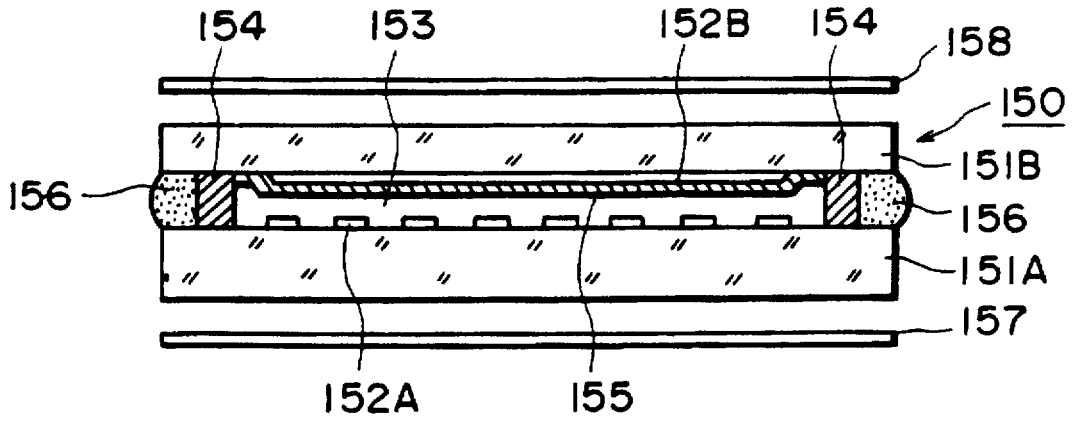
FIG. 15B is a sectional view taken along the line 15B–15B' therein.

FIGS. 15A and 15B illustrate an embodiment of the liquid crystal device according to the present invention. FIG. 15A is a plan view of the embodiment and FIG. 15B is a sectional view taken along the line 15–15B' in FIG. 15A.

A cell structure 150 shown in FIG. 15 comprises a pair of substrates 151A and 151B made of glass plates or plastic plates which are held with a predetermined gap with spacers 154 and sealed with an adhesive 156 to form a cell structure. On the substrate 151A is further formed an electrode group (e.g., an electrode group for applying scanning voltages of a matrix electrode structure) comprising a plurality of transparent electrodes 152A in a predetermined pattern, e.g., of a stripe pattern. On the substrate 151B is formed another electrode group (e.g., an electrode group for applying signal voltages of the matrix electrode structure) comprising a plurality of transparent electrodes 152B intersecting with the transparent electrodes 152A.

On the substrate 151B provided with such transparent electrodes 152B may be further formed an alignment control film 155 composed of an inorganic insulating material such as silicon monoxide, silicon dioxide, aluminum oxide, zirconia, magnesium fluoride, cerium oxide, cerium fluoride, silicon nitride, silicon carbide, and boron nitride, or an organic insulating material such as polyvinyl alcohol, polyimide, polyamide-imide, polyester-imide, polyparaxylylene, polyester, polycarbonate, polyvinyl acetal, polyvinyl chloride, polyamide, polystyrene, cellulose resin, melamine resin, urea resin and acrylic resin.

The alignment control film 155 may be formed by first forming a film of an inorganic insulating material or an organic insulating material as described above and then rubbing the surface thereof in one direction with velvet, cloth, paper, etc.

In another preferred embodiment according to the present invention, the alignment control film 155 may be formed as a film of an inorganic insulating material such as SiO or $SiO_2$ on the substrate 151B by the oblique or tilt vapor deposition.

In another embodiment, the surface of the substrate 151B of glass or plastic per se or a film of the above-mentioned inorganic material or organic material formed on the substrate 151B is subjected to oblique etching to provide the surface with an alignment control effect.

It is preferred that the alignment control film 155 also functions as an insulating film. For this purpose, the alignment control film may preferably have a thickness in the range of 100 Å to 1 micron, especially 500 to 5000 Å. The insulating film also has a function of preventing the occurrence of an electric current which is generally caused due to minor quantities of impurities contained in the liquid crystal layer 153, whereby deterioration of the liquid crystal compounds is prevented even on repeating operations.

As the ferroelectric liquid crystal 153, a liquid crystal compound or composition showing chiral smectic phase as disclosed in U.S. Pat. Nos. 4,561,726, 4,614,609, 4,589,996, 4,592,858, 4,596,667, 4,613,209, etc., may be used.

The device shown in FIGS. 15A and 15B further comprises polarizers 153 and 158 having polarizing axes crossing each other, preferably at 90 degrees.

As described above, according to the present invention, in partial rewriting scanning for a display apparatus having a memory characteristic such as a ferroelectric liquid crystal display apparatus, the partial rewriting region is defined by a rewriting start scanning line address and the number of rewriting scanning lines. Further, a means is provided for observing the scanning line address of image data transferred, and if another partial rewriting demand occurs during one partial rewriting process, priority levels of display data of demanded partial rewriting are judged to effect the partial rewriting operations in the order of from a higher priority level (e.g. movement of a pointing device) to a lower one. As a result, even in a display driven at a low frame frequency, there can be realized a display apparatus which is adapted to a highly developed display application program involving movement of a pointing device or cursor, a multi-window display and a multi-task display. Particularly, according to the present invention, the display quality of a moving font display such as that of a mouse cursor can be improved regardless of a moving font position and without causing a local display failure of a moving font.

Figure 16:
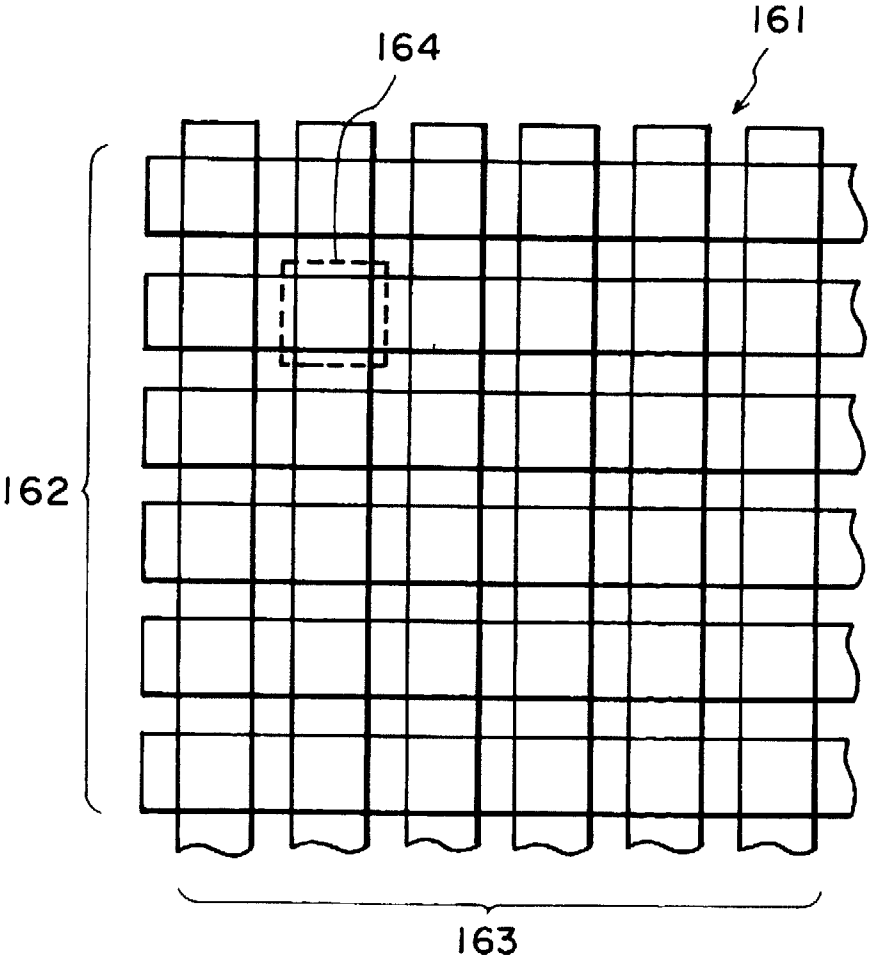
FIG. 16 is a plan view of matrix electrodes.

FIG. 16 is a plan view of matrix electrodes 161 constructing the display panel 103 in FIG. 1. Scanning electrode 162 and information electrodes 163 intersect and pixels 164 are formed at the intersecting points. A ferroelectric liquid crystal is arranged between the scanning electrodes 162 and the information electrodes 163.

Figure 17:
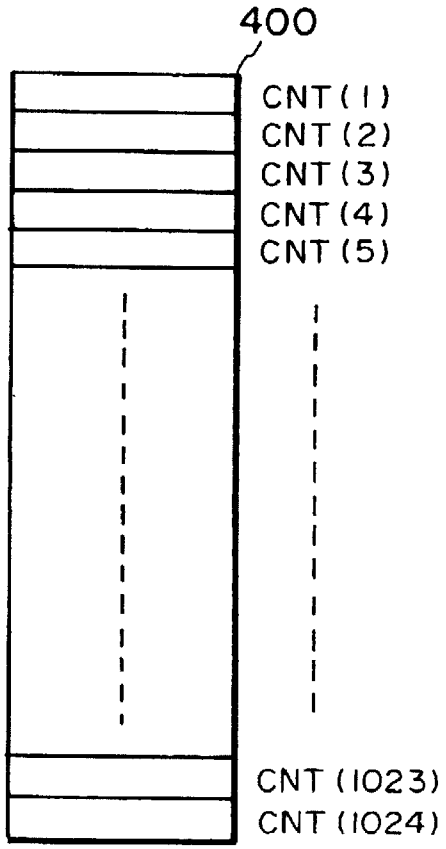
FIG. 17 is a diagrammatical view of a counter memory group.

FIG. 17 shows a counter memory group provided for a scan signal control circuit 115 in order to detect an elapsed period of time after the scan selection signal was applied to each scanning electrode 162. As shown in the diagram, a counter memory group 400 have counter memories CNT(1) to CNT(1024) of the same number as that of the scanning electrodes. The number of horizontal scanning times after the scanning line address data of the corresponding scanning electrode was sent is recorded in each counter memory.

Figure 18:
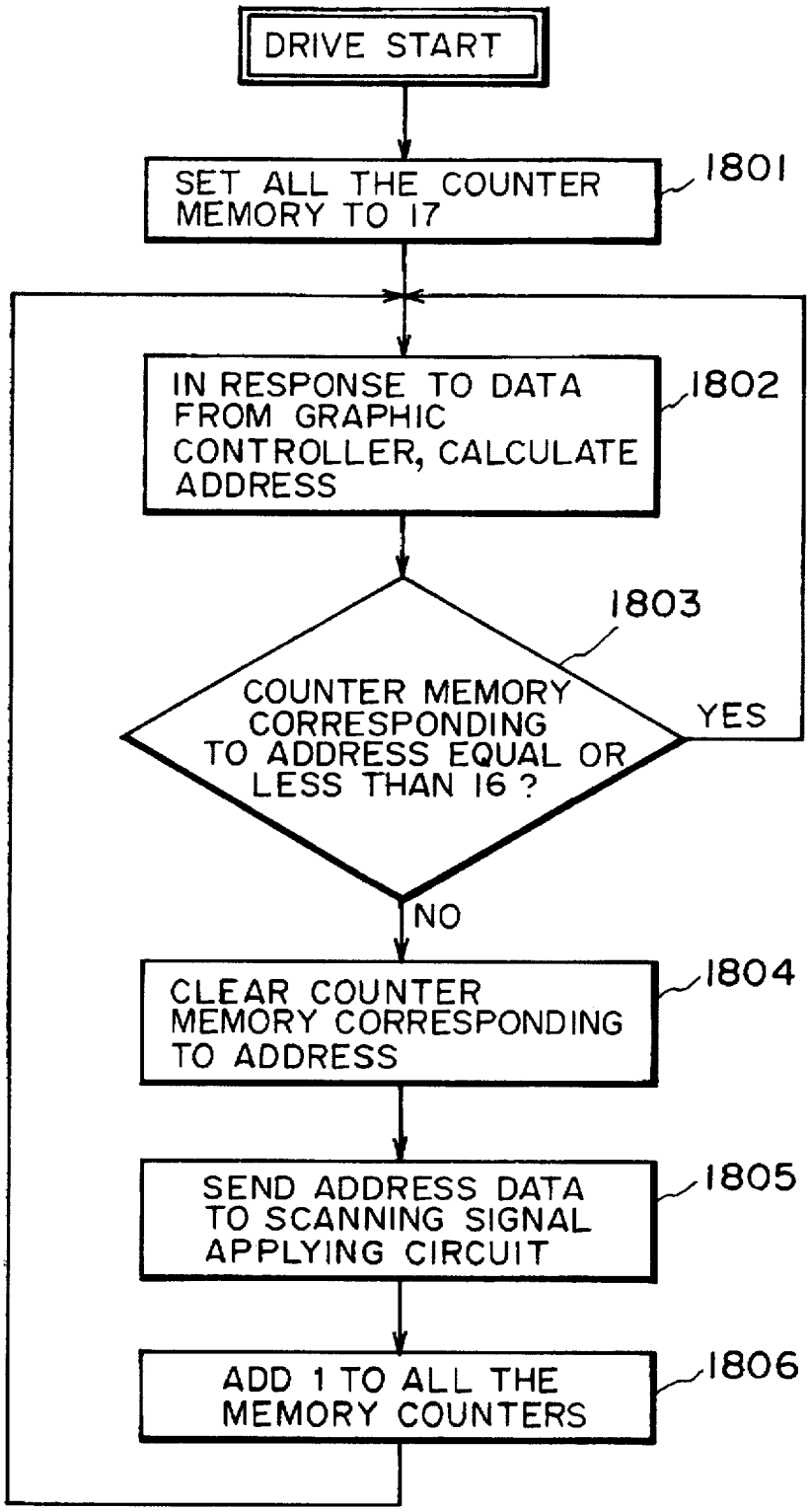
FIG. 18 is a flowchart showing an algorithm to send scanning line address data.

FIG. 18 is a flowchart showing an algorithm to send the scanning line address data from the scan signal control circuit 115 to the scan signal applying circuit 107. That is, when the driving is started, in step 1801, "17" is set into all of the counter memories CNT(1) to CNT(1024) in order to send the address data to the scan signal applying circuit 107 even when any address is selected at the initial stage. In step 1802, the scan signal control circuit 115 receives data from the graphic controller 102 and calculates an address from the data. In step 1803, the scan signal control circuit 115 checks to see if the content of the counter memory CNT (address) corresponding to the above calculated address is equal to "16" or less or not in order to discriminates whether the interval of "16" horizontal scanning periods after the scan signal was lastly applied to the scanning electrode corresponding to the address calculated in step 1802 has elapsed or not irrespective of the scanning method in the whole/one screen rewriting scanning mode or in the partial rewriting scanning mode. When it is equal to or less than "16", the processing routine is returned to step 1802 When it exceeds "16", step 1804 follows. In step 1804, the content of the counter memory CNT (address) corresponding to the address is cleared to "0". In step 1805, the scan signal control circuit 114 sends the address data to the scan signal applying circuit 107. In step 1806, "1" is added to the count values of all of the counter memories in order to record the elapse of one horizontal period of time. After that, the processing routine is returned to step 1802 and the above processes are repeated. Thus, a situation such that the interval in which the signal is applied to an arbitrary scanning electrode is shorter than the "16" horizontal scanning periods is eliminated. Even in the case where the partial rewriting scan has frequently occurred, the decrease in driving margin, deterioration in orientation state of the liquid crystal, and decrease in contrast which have occurred hitherto are suppressed.

Figure 19:
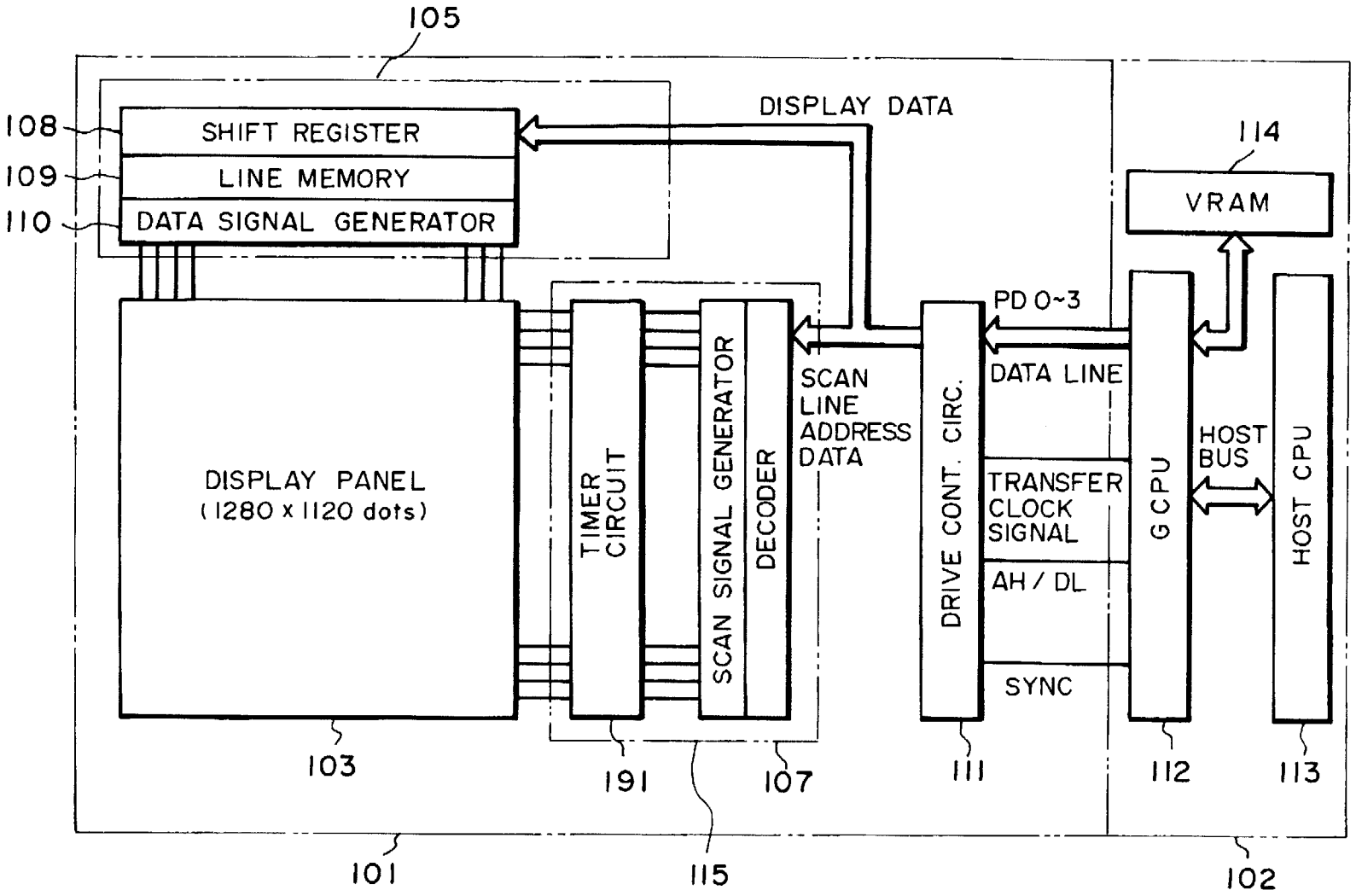
FIG. 19 is a block diagram of another liquid crystal apparatus of the invention.

FIG. 19 shows a liquid crystal display apparatus according to another embodiment of the invention. The apparatus uses a timer circuit 191 in place of the counter memory group 400 in the apparatus of FIG. 1. The other constructions are similar to those in the case of the foregoing embodiment.

Figure 20:
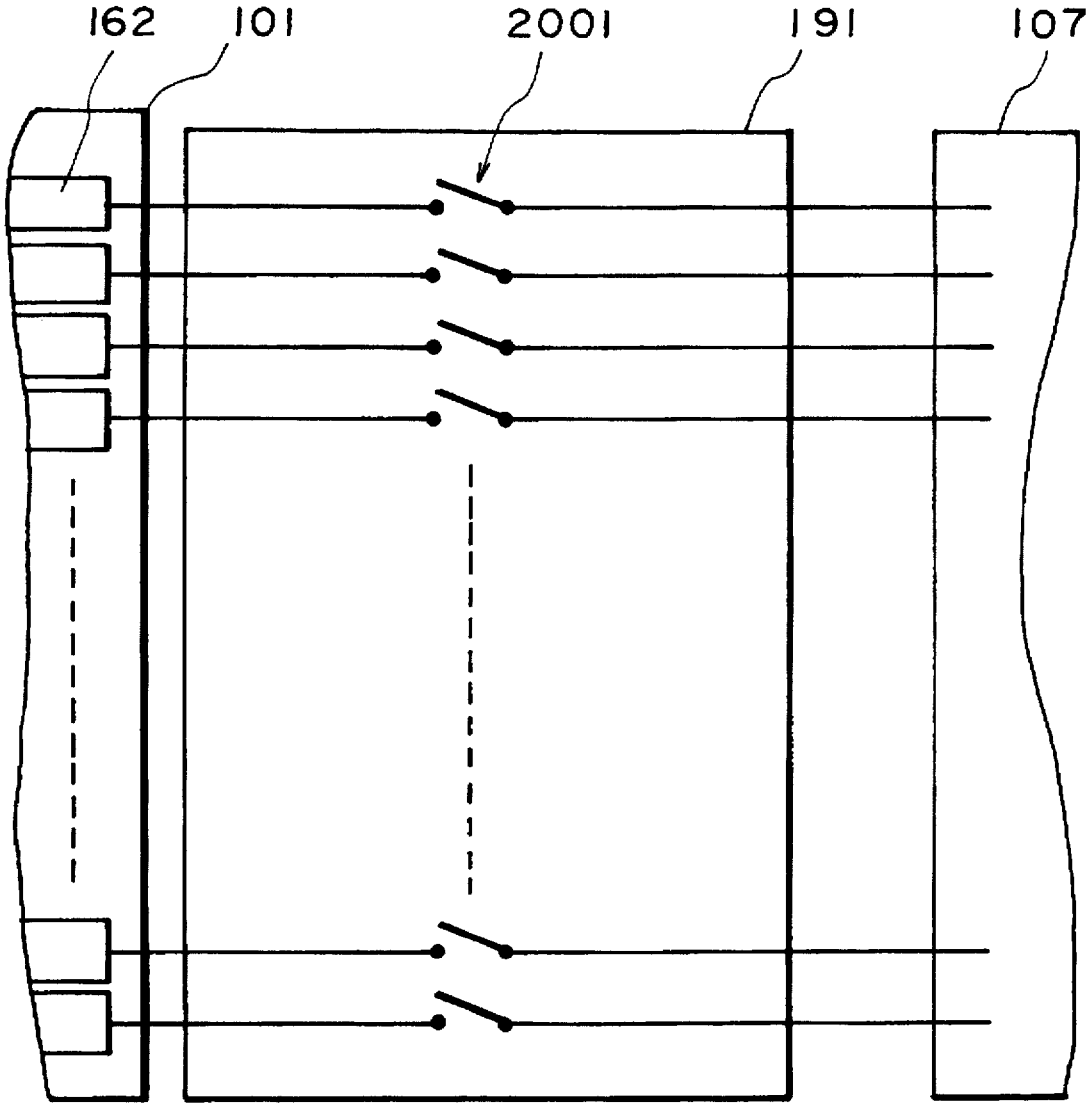
FIG. 20 is a diagrammatical view of a switching circuit.
Figure 21:
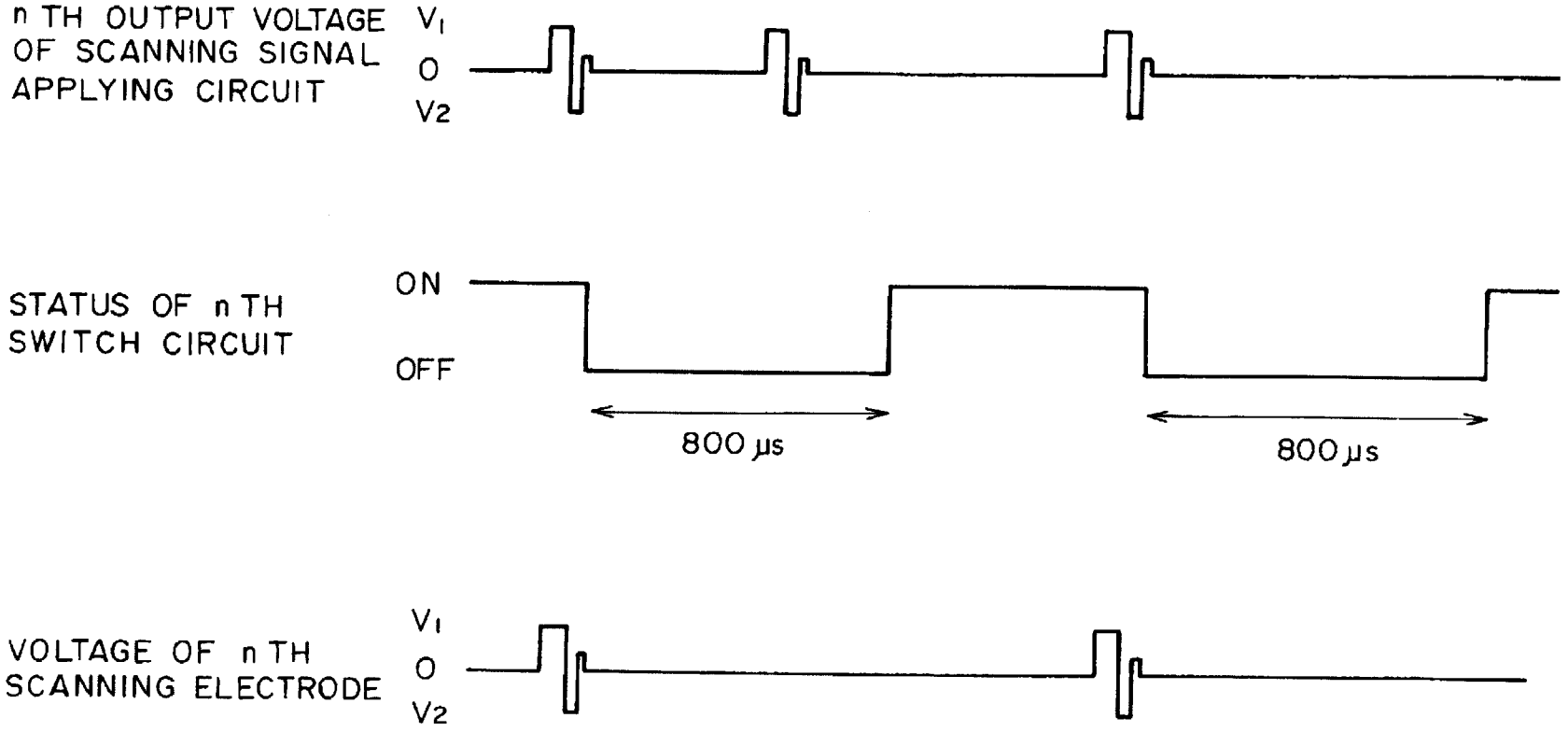
FIG. 21 is a flowchart showing the operation of the switching circuit.

As shown in FIG. 20, the timer circuit 191 has 1024 switching circuits 2001 arranged between the scan signal applying circuit 107 and the 1024 scanning electrodes 162. As shown in FIG. 21, the on/off timings of the switching circuits 2001 are set in a manner such that the nth switching circuit 2001 is turned off for a period of time of 800 μsec just after the scan signal was applied to the nth scanning electrode 162 and, during such a period of time, the nth scanning electrode 162 is set into a high impedance. Thus, no scan signal is applied to the scanning electrode for a period of time of 800 μsec just after the scan signal applying circuit 107 applied the scan signal. Even when the partial rewriting scan has frequently occurred in the same address, the interval when the signal is applied to the scanning electrode is not shorter than 800 μsec.

According to the invention as described above, since the frequency at which the scan signal is applied to the same scanning electrode is suppressed to a predetermined limit value, even in the case of using the partial rewriting scanning method having an excellent smoothness of the moving display or the like, the decrease in driving margin, deterioration of the orientation state of the liquid crystal, decrease in contrast, and the like can be suppressed.

What is claimed is:

1. A liquid crystal apparatus comprising:

a matrix of electrodes formed by a scanning electrode group and an information electrode group which intersect said scanning electrode group so as to face the scanning electrode group;

a liquid crystal having a memory function which is arranged between said electrode groups and is driven by an electric field applied through said electrode groups;

means for providing input information;

a drive circuit having a scanning side drive circuit for sequentially supplying scan selection signals to the scanning electrode group and for generating scan non-selection signals to the scanning electrodes whose scan is not selected and an information side drive circuit for supplying information signals to said information electrode group synchronously with the scan selection signal in accordance with the input information; and control means for controlling said drive circuit by selecting one of first and second modes, wherein, in the first mode the drive circuit is controlled so that the scan selection signal is applied sequentially to each of the scan electrodes to form a full image during one full-image vertical scan interval, and wherein in the second mode the drive circuit is controlled so that each of a plurality of the scan electrodes corresponding to a partial image area of the full image are designated and the scan signal is applied sequentially to each of the designated scan electrodes in a partial vertical scan during a partial-image vertical scan interval, wherein, when said second mode is selected and partial-image vertical scans are successively and repetitively made at least two times only for the designated same scan electrodes, thereby displaying a movement of a cursor in a horizontal direction, an interval between application of two scan selection signals to a particular one of the designated scan electrodes in successive repetitive partial-image vertical scans is set to be longer than a period of one of the partial-image vertical scans among said repetitive partial-image vertical scans.

2. An apparatus according to claim 1, wherein an application interval between the two scan selection signals to the particular one of the designated scan electrodes is at least 16 times as long as a time for applying the scan selection signal.

3. An apparatus according to claim 1, further including means for setting an application interval between the two scan selection signals shorter than the full image-vertical scan interval.

4. A liquid crystal apparatus according to claim 1, wherein said liquid crystal having the memory function is a chiral smectic liquid crystal.

5. A liquid crystal apparatus according to claim 4, wherein said chiral smectic liquid crystal is a ferroelectric liquid crystal.

* * * * *

UNITED STATES PATENT AND TRADEMARK OFFICE

CERTIFICATE OF CORRECTION

PATENT NO. : 5,675,354

DATED : October 7, 1997

INVENTOR(S) : KAZUNORI KATAKURA ET AL.

It is certified that error appears in the above-identified patent and that said Letters Patent is hereby corrected as shown below:

COLUMN 6

Line 46, "my" should read --may--.

COLUMN 7

Line 53, "storage, region" should read --storage region--;
Line 59, "in. RAM" should read --in RAM--.

COLUMN 9

Line 58, "As-shown" should read --As shown--.

COLUMN 11

Line 12, "in" should read --In--.

COLUMN 14

Line 31, "discriminates" should read --discriminate--;
Line 39, "1802 when" should read --1802. When--;
Line 42, "114" should read --115--.

Signed and Sealed this

Nineteenth Day of May, 1998

Bruce Lehman

*Attest:*

BRUCE LEHMAN

*Attesting Officer*

*Commissioner of Patents and Trademarks*